US006557388B1

(12) United States Patent
Mitsumaru et al.

(10) Patent No.: US 6,557,388 B1
(45) Date of Patent: May 6, 2003

(54) METHOD OF DETERMINING DIMENSION OF EXTRUSION DIE AND EXTRUSION DIE PRODUCED BASED ON THE SAME

(75) Inventors: Akira Mitsumaru, Tokyo (JP); Kazumi Kato, Tokyo (JP); Kazuhiro Itabashi, Tokyo (JP); Toshiyuki Kakinoki, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/536,722

(22) Filed: Mar. 28, 2000

(30) Foreign Application Priority Data

Apr. 6, 1999 (JP) ..... 11-099170

(51) Int. Cl.[7] ..... B21C 23/00; B21K 5/20

(52) U.S. Cl. ..... 72/253.1; 72/271; 72/467; 76/4; 76/107.1; 76/107.4; 703/1

(58) Field of Search ..... 72/253.1, 271, 72/467; 76/4, 107.1, 107.4; 703/1, 2; 700/97, 98, 117, 118; 345/419, 420, 441, 442

(56) References Cited

U.S. PATENT DOCUMENTS

| | | | | |
|---|---|---|---|---|
| 5,275,046 A | * | 1/1994 | Nagpal et al. | 72/467 |
| 5,511,450 A | * | 4/1996 | Nagao | 76/107.1 |
| 5,870,922 A | * | 2/1999 | Rodriquez et al. | 72/271 |
| 6,062,059 A | * | 5/2000 | Feldcamp | 72/271 |
| 6,374,198 B1 | * | 4/2002 | Schifa et al. | 703/2 |

* cited by examiner

*Primary Examiner*—Ed Tolan
(74) *Attorney, Agent, or Firm*—Oblon, Spivak, McClelland, Maier & Neustadt, P.C.

(57) ABSTRACT

A method of determining at least one dimension of an extrusion die includes determining a plurality of reference points on a contour of an opening of the extrusion die. Sizes of a plurality of figures with same shapes corresponding to the plurality of reference points are determined. Each of the plurality of figures is inscribed in the contour of the opening and has at least one axis of symmetry. Each of the plurality of figures contacts each of the plurality of reference points and at least one another point on the contour. The at least one dimension of the extrusion die is determined based on the sizes of the plurality of figures.

68 Claims, 17 Drawing Sheets

METHOD OF DETERMINING DIMENSION OF EXTRUSION DIE AND EXTRUSION DIE PRODUCED BASED ON THE SAME

CROSS-REFERENCE TO RELATED APPLICATIONS

The present application claims priority under 35 U.S.C. §119 to Japanese Patent Application No. 11-099170, filed Apr. 6, 1999, entitled "Method Of Producing Extrusion Die, Apparatus For Producing The Same, And Extrusion Die Produced By The Method". The contents of that application are incorporated herein by reference in their entirety.

BACKGROUND OF THE INVENTION

1. Field of the Invention

The present invention relates to a method of determining at least one dimension of an extrusion die, and an extrusion die produced based on the method.

2. Discussion of the Background

As is obvious from its schematic structure shown in FIG. 1, an extrusion press 10 used for extrusion generally is constructed by a container 11, an extrusion die 12 fixed to one end of the container 11, a stem 13 movably mounted on a pushing ram at the other end of the container 11, and a bolster 16 for fixing the container 11 and the extrusion die 12 through a backer 14 and a die ring 15. An extrusion method is, for example, a hot working method including placing a cylindrical aluminum billet in the container 11 interposed between the extrusion die 12 and the stem 13 and moving the stem 13 to extrude the billet into a product from the extrusion die 12. Most billets used for extrusion are cylindrical but square billets may be used. When a material having excellent hot workability such as aluminum is extruded by the above method, even a product having a complicated shape may be obtained.

The extrusion die used for extrusion has a shape shown in FIG. 2 as an example. The design values of the extrusion die mostly depend on the thickness of an extruded product and typical design factors include a bearing length and a flow guide shape. In this invention a flow guide shape or a chamber shape means absolute shape: that is because shape has the meanings of both size and shape.

The bearing is a part to give friction to an extrusion material for controlling a metal flow and formed at the outlet of the extrusion die. For example, in the case of a solid (product having no hollow portion) extrusion die shown in FIG. 2, the bearing is a portion where an extrusion material is extruded (in the figure, the inner wall of a die hole corresponding to the cross-section of a product). The purpose of forming the bearing is to form an extruded product having a desired shape. Stated more specifically, by changing the wall length of a bearing at each portion, a metal flow is controlled making use of friction at the time of extrusion to mold in an extruded product having a desired shape. That is, by changing the length of a part to give friction to a metal according to the shape of a product, a metal flow is controlled properly and a product of high quality which cannot be bent by metal flow or the like is extruded.

Generally speaking, when there is nonuniformity in the thickness of a product, the metal flow rate tends to be higher in a thick portion than in a thin portion at the time of extrusion. Therefore, the wall length of a bearing of a portion corresponding to the thick portion must be designed relatively larger than the wall length of a bearing of a portion corresponding to the thin portion. Thus, the determination of the wall length of the bearing is one of important factors that affect extrusion results in terms of the size and shape of an extrusion material.

A description is subsequently given of a general method of determining the wall length of a bearing.

Points (points along the die opening for calculating the wall length of a bearing) for calculating the wall length of a bearing on an opening (die hole shape) of a die are first determined. For example, when a product has a sectional shape as shown in FIG. 3, two different points (points A and B) on the reference line of the bottom portion of the section are selected. Thereafter, thicknesses at these calculation points are measured and the wall length of the bearing is calculated using the bearing wall length calculation equation of each designer. A die having the calculated bearing wall length is produced and extrusion is carried out using this die. Stated more specifically, based on the thickness of 40 mm at the point A and the thickness of 15 mm at the point B, the wall length of the bearing between points A and B is obtained.

Even when the measurement of the thickness of a product is carried out by each designer independently, in the case of a straight angular shape surrounded by parallel straight lines as shown in FIG. 4, since the shape is simple and a single design standard can be applied, differences among the concepts of designers and the methods of applying design standards are rarely occurred.

However, since extruded products are various in shape, there are differences in thickness measurement among designers with the result that dies which are designed differently may be obtained. For example, in the case of a product having a shape shown in FIG. 5, definition "a" and definition "b" are conceivable for the determination of thickness at point C in the figure and there is a difference in the measurement value of thickness according to differences in concept among designers and design standards such as thickness measurement method and the like.

Since the shape of the opening of an extrusion die is complicated and various, in the present situation in which a reference line is used to measure the thickness of an extrusion material as the basis of the design of a bearing or the measurement of thickness depends on the judgment of each designer, the step of making a bulky manual describing a huge number of product shape patterns and minute rules is required to reduce differences in thickness measurement method among designers.

When a die opening is shaped like an ameba having no symmetry at any portions, "thickness" itself cannot be defined, thereby making it impossible to design a bearing based on predetermined standards by a conventional bearing design method.

Meanwhile, CAD has been frequently used for the design of an extrusion die in recent years. Even when CAD is used, product thickness measurement methods are classified by the shape of a die opening and further complicated rules are incorporated into a CAD program, a huge number of program production steps and a huge number of maintenance steps are required to produce a program which covers all kinds of products having thousands of different shapes. Further, since thickness itself cannot be defined even by using CAD incorporating design standards based on conventional design techniques, the above opening having a completely unsymmetric shape cannot be incorporated into a CAD program, thereby making it impossible to automate the design of a die.

Moreover, since there is such a case as lack of some patterns or rules, a method of defining the measurement of the thickness of a product according to the shape of a product in an one-to-one correspondent manner is necessary even if any type of the product shape is given.

The following two typical methods have been used to define thickness.

The first method (1) is, as shown in FIG. 6, to draw inward a perpendicular or normal to an element (line segment or circular arc) belonging to a bearing wall length calculation point D ($D_1$, $D_2$, . . . ) on an opening from the calculation point D, obtain an intersection point E ($E_1$, $E_2$, . . . ) with an element on the opposite side, and define the distance between the intersection point E and the bearing wall length calculation point D as thickness.

The second method (2) is, as shown in FIG. 7, to provide a predetermined reference line on the under surface of extrusion for the shape of a product, draw inward a perpendicular to the reference line from a bearing wall length calculation point F ($F_1$, $F_2$, . . . ), obtain an intersection point G ($G_1$, $G_2$, . . . ) with an element on the opposite side and define the distance between the intersection point G and the bearing wall length calculation point F as thickness.

According to the above methods, it is possible to define thickness based on a specific method but there is a problem in fact. Stated more specifically, when the thickness of a product of FIG. 8 is measured by the method (1), the wall length of a bearing is longer at point K than at point H and the wall length of the bearing changes abruptly.

The method (2) has such a problem that the value of thickness defined differs according to how to take a reference line. For example, although a product shown in FIG. 9 is similar in shape to a product shown in FIG. 7 (they differ only in the existence of a projecting portion), they differ in the value of thickness defined because they differ in reference line.

That is, various thicknesses are obtained according to how to take a reference line.

Therefore, in these bearing design methods, even when products have almost the same shape, if they differ only in the shape of a minute portion, extrusion dies having different bearing wall lengths are produced. Further, when the thickness of a product changes abruptly, the wall length of a bearing cannot be changed smoothly according to the shape of a die opening and the shape of a product may not be stabilized.

Moreover, in the case of a completely unsymmetric ameba-like shape, a reference line cannot be drawn, and in the conventional bearing design method, the size of a bearing cannot be determined based on predetermined standards. The same problems as above are encountered even when a completely unsymmetric portion is a part of a product figure.

As an important factor of an extrusion die that affects extrusion results in terms of the size and shape of a product, a flow guide or chamber is named. The flow guide or chamber is one of means of controlling a metal flow and formed similar in shape to a product in an extrusion die to control a metal flow in order to make up for limitation to the control of a metal flow with a bearing, thereby being capable of stabilizing the shape of a product of an extrusion material with these.

The term "flow guide" as used herein is mainly used in the case of a solid die and includes a feeder or baffle plate formed to a predetermined shape as a unit separate from a well formed in an extrusion die and an extrusion die. They are generally defined as "flow guide".

In the case of a hollow die, an extrusion material passes through a metal welding chamber called "chamber" and a metal flows into a bearing. Therefore, the metal welding chamber has the same function as that of the flow guide.

However, as for the design of the flow guide or chamber, an appropriate design method for obtaining an appropriate product shape is not established like the design of a bearing. Design standards based on the judgment or past experience of each designer are selected, and a design method for determining the shape of a flow guide or chamber for a product having a desired shape in an one-to-one correspondent manner is not established, which is one of the reasons why the shape of an extruded product is not stabilized.

SUMMARY OF THE INVENTION

According to one aspect of the invention, a method of determining at least one dimension of an extrusion die includes determining a plurality of reference points on a contour of an opening of the extrusion die. Sizes of a plurality of figures with same shapes corresponding to the plurality of reference points are determined. Each of the plurality of figures is inscribed in the contour of the opening and has at least one axis of symmetry. Each of the plurality of figures contacts each of the plurality of reference points and at least one another point on the contour. The at least one dimension of the extrusion die is determined based on the sizes of the plurality of figures.

According to another aspect of the invention, a method of producing an extrusion die includes determining a plurality of reference points on a contour of the opening of the extrusion die. Sizes of a plurality of figures with same shapes corresponding to the plurality of reference points are determined. Each of the plurality of figures is inscribed in the contour of the opening and has at least one axis of symmetry. Each of the plurality of figures contacts each of the plurality of reference points and at least one another point on the contour. The at least one dimension of the extrusion die is determined based on the sizes of the plurality of figures. The extrusion die is produced based on the at least one dimension. According to further aspect of the invention, an extrusion die includes an opening through which material is extruded; and at least one portion having a dimension determined based on sizes of a plurality of figures with same shapes. Each of the plurality of figures has at least one axis of symmetry and is determined corresponding to each of a plurality of reference points which are determined on a contour of the opening. Each of the plurality of figures is inscribed in the contour of the opening and contacts each of the plurality of reference points and at least one another point on the contour.

According to yet another aspect of the invention, a flow guide for an extrusion die which has an opening through which material is extruded includes a portion having a dimension determined based on sizes of a plurality of figures with same shapes. Each of the plurality of figures has at least one axis of symmetry and is determined corresponding to each of a plurality of reference points which are determined on a contour of the opening. Each of the plurality of figures is inscribed in the contour of the opening and contacts each of the plurality of reference points and at least one another point on the contour.

According to yet another aspect of the invention, a chamber for an extrusion die which has an opening through which material is extruded includes a portion having a dimension determined based on sizes of a plurality of figures with same shapes. Each of the plurality of figures has at least one axis of symmetry and is determined corresponding to each of a plurality of reference points which are determined on a contour of the opening. Each of the plurality of figures is inscribed in the contour of the opening and contacts each of the plurality of reference points and at least one another point on the contour.

According to further aspect of the invention, an extrusion die designing apparatus to design an extrusion die having an opening through which material is extruded, includes a reference point determining device, a figure size determining device and a dimension determining device. The reference point determining device is configured to determine a plurality of reference points on a contour of the opening of the extrusion die. The figure size determining device is configured to determine sizes of a plurality of figures with same shapes corresponding to the plurality of reference points. Each of the plurality of figures is inscribed in the contour of the opening and has at least one axis of symmetry. Each of the plurality of figures contacts each of the plurality of reference points and at least one another point on the contour. The dimension determining device is configured to determine at least one dimension of the extrusion die based on the sizes of the plurality of figures.

According to yet another aspect of the invention, an extrusion die designing apparatus to design an extrusion die including an opening through which material is extruded, includes reference point determining means, figure size determining means and dimension determining means. The reference point determining means determine a plurality of reference points on a contour of the opening of the extrusion die. The figure size determining means determine sizes of a plurality of figures with same shapes corresponding to the plurality of reference points. Each of the plurality of figures is inscribed in the contour of the opening and has at least one axis of symmetry. Each of the plurality of figures contacts each of the plurality of reference points and at least one another point on the contour. The dimension determining means determine at least one dimension of the extrusion die based on the sizes of the plurality of figures.

According to yet another aspect of the invention, an extrusion die producing system to produce an extrusion die having an opening through which material is extruded, includes a reference point determining device, a figure size determining device, a dimension determining device and a machine. The reference point determining device is configured to determine a plurality of reference points on a contour of the opening of the extrusion die. The figure size determining device is configured to determine sizes of a plurality of figures with same shapes corresponding to the plurality of reference points. Each of the plurality of figures is inscribed in the contour of the opening and has at least one axis of symmetry. Each of the plurality of figures contacts each of the plurality of reference points and at least one another point on the contour. The dimension determining device is configured to determine at least one dimension of the extrusion die based on the sizes of the plurality of figures. The machine is configured to produce the extrusion die based on the at least one dimension.

According to yet another aspect of the invention, a computer readable media is provided for controlling a computer to perform the steps of determining a plurality of reference points on a contour of the opening of the extrusion die; determining sizes of a plurality of figures with same shapes corresponding to the plurality of reference points, each of the plurality of figures being inscribed in the contour of the opening and having at least one axis of symmetry, each of the plurality of figures contacting each of the plurality of reference points and at least one another point on the contour; and determining the at least one dimension of the extrusion die based on the sizes of the plurality of figures.

The above and other objectives, features and advantages of the present invention will become more apparent from the following description when taken in conjunction with the accompanying drawings.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DESCRIPTION OF THE PREFERRED EMBODIMENTS

Figure 1:
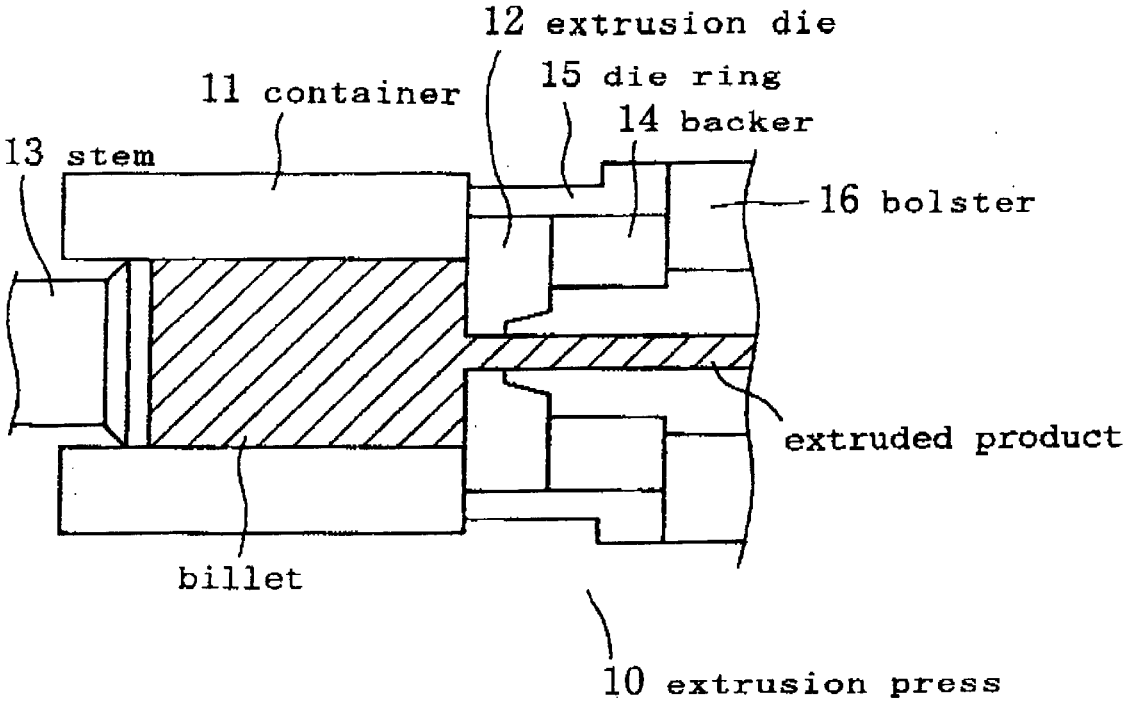
FIG. 1 is a sectional view schematically showing the constitution of an extrusion press 10.
Figure 2:
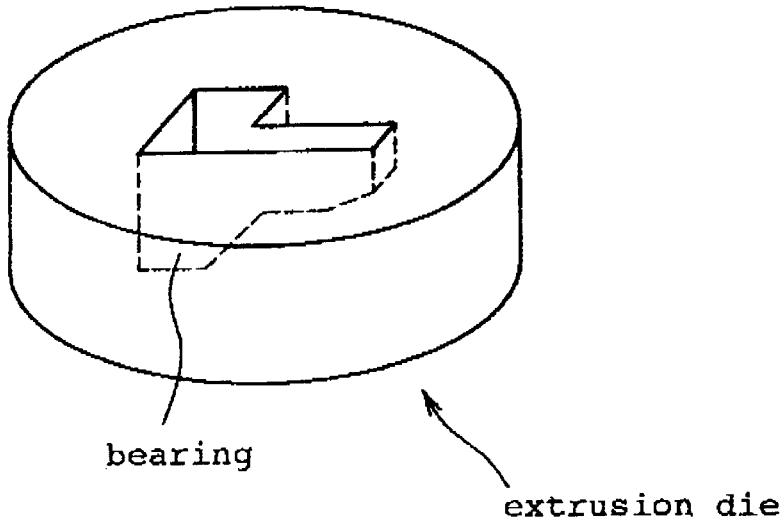
FIG. 2 is a perspective view schematically showing an example of extrusion die (regular die)
Figure 3:
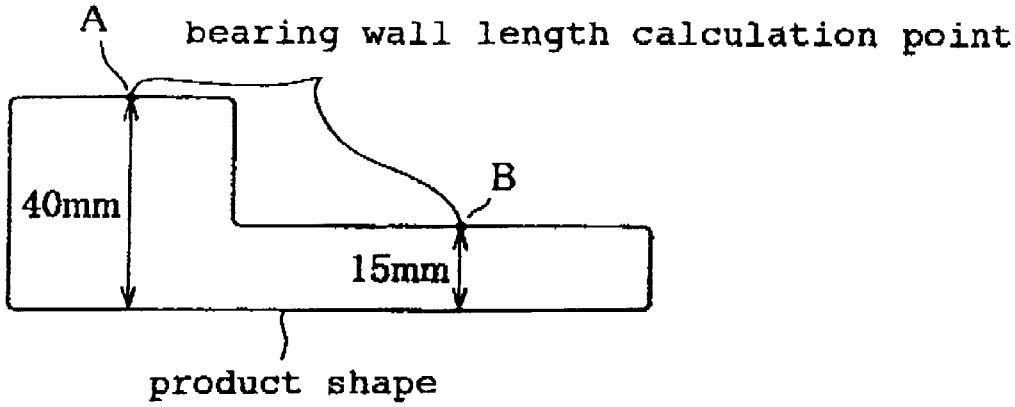
FIG. 3 is a diagram showing an example of conventional method of measuring the thickness of a product.
Figure 4:
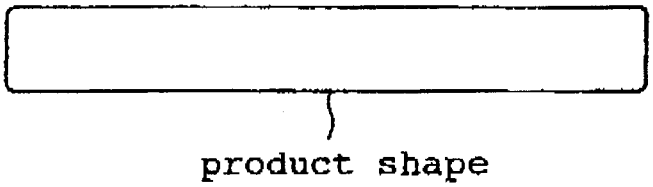
FIG. 4 is a diagram showing an example of simple product shape.
Figure 5:
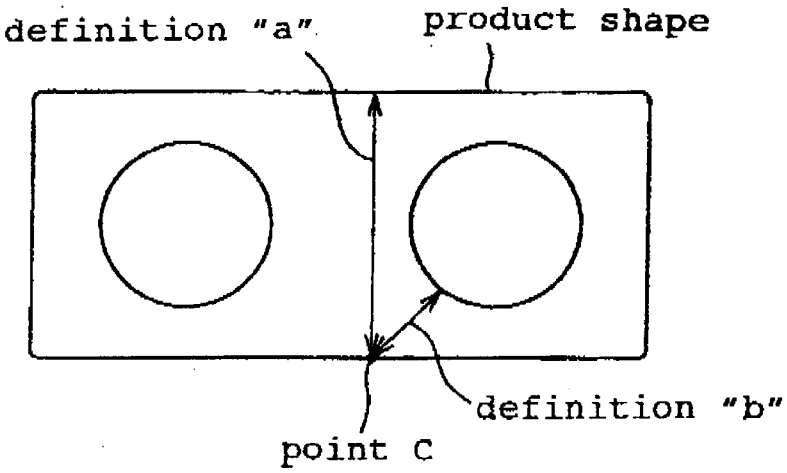
FIG. 5 is a diagram showing an example of product shape which easily produces a difference in the definition of thickness.
Figure 6:
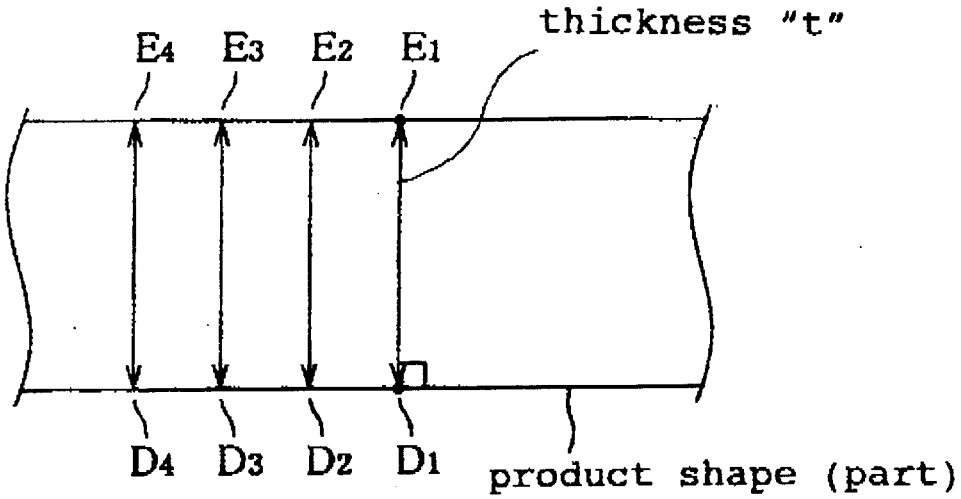
FIG. 6 is a diagram showing a method of measuring the thickness of a product by a perpendicular or normal.
Figure 7:
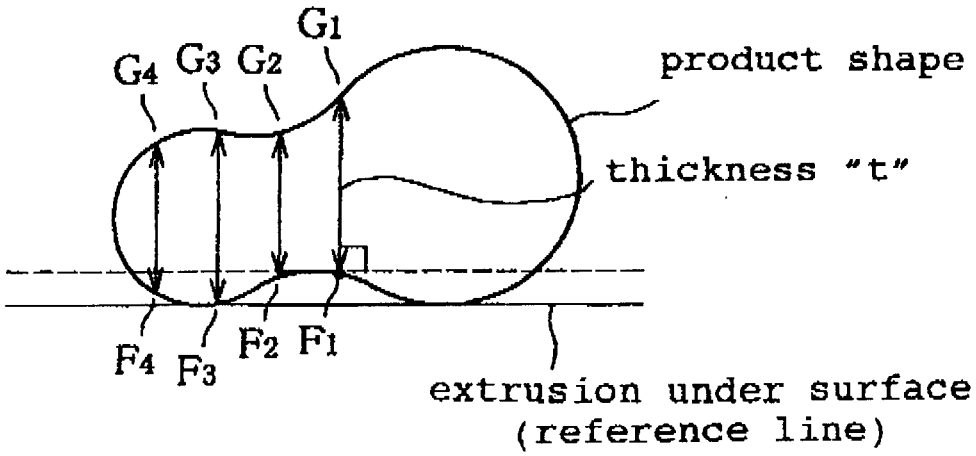
FIG. 7 is a diagram showing a method of measuring the thickness of a product by a perpendicular or normal from a reference line (extrusion under surface of a product)
Figure 8:
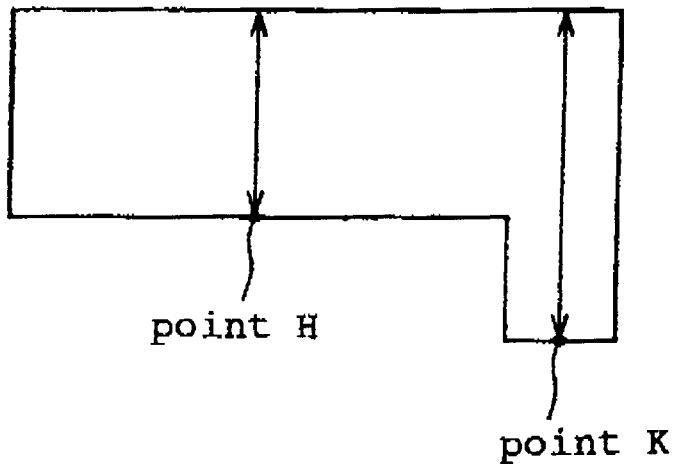
FIG. 8 is a diagram showing an example of product shape which causes inconvenience with the thickness measurement method of FIG. 6.
Figure 9:
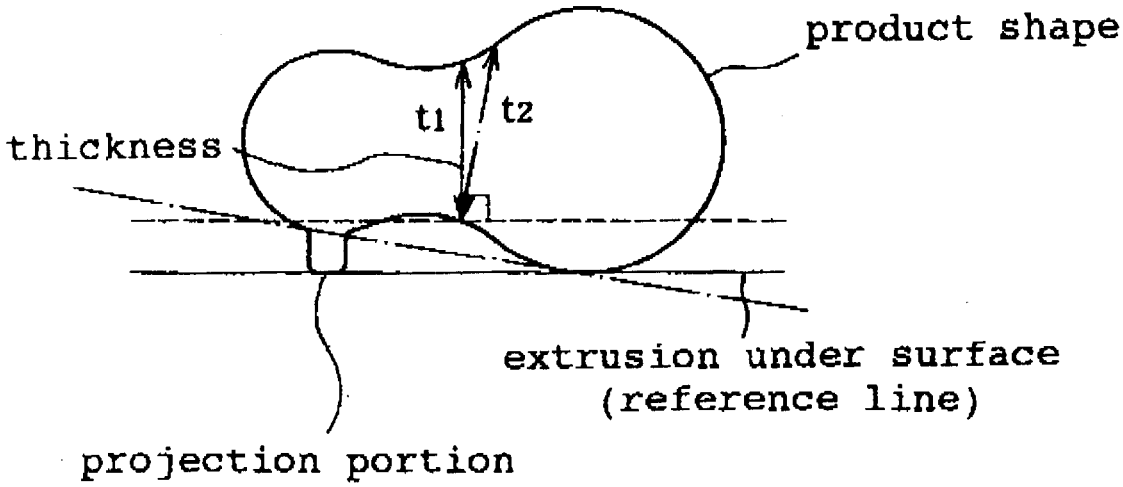
FIG. 9 is a diagram showing an example of product shape which causes inconvenience with the thickness measurement method of FIG. 7.

The preferred embodiments will now be described with reference to the accompanying drawings, wherein like reference numerals designate corresponding or identical elements throughout the various drawings.

Figure 31:
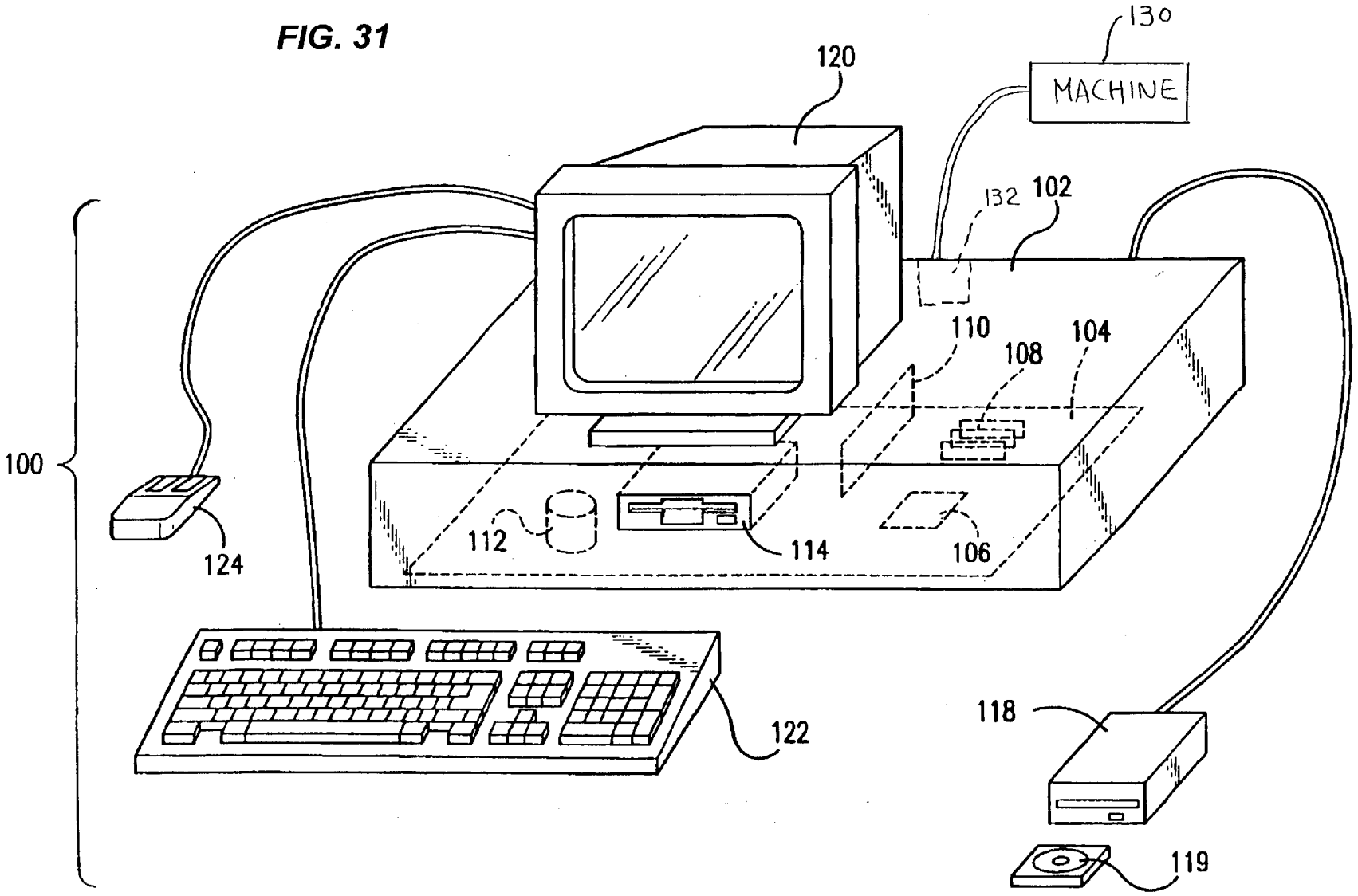
FIG. 31 is a schematic illustration of an extrusion die producing system utilizing a computer.

FIG. 31 is a schematic illustration of an extrusion die producing system utilizing a computer for determining at least one dimension of an extrusion die and controlling a machine tool. A computer 100 implements the method of the present invention, wherein the computer housing 102 houses a motherboard 104 which contains a CPU 106, memory 108 (e.g., DRAM, ROM, EPROM, EEPROM, SRAM, SDRAM, and Flash RAM), and other optional special purpose logic devices (e.g., ASICs) or configurable logic devices (e.g., GAL and reprogrammable FPGA). The computer 100 also includes plural input devices, (e.g., a keyboard 122 and mouse 124), and a display card 110 for controlling monitor 120. In addition, the computer system 100 further includes a floppy disk drive 114; other removable media devices (e.g., compact disc 119, tape, and removable magneto-optical media (not shown)); and a hard disk 112, or other fixed, high density media drives, connected using an appropriate device bus (e.g., a SCSI bus, an Enhanced IDE bus, or a Ultra DMA bus). Also connected to the same device bus or another device bus, the computer 100 may additionally include a compact disc reader 118, a compact disc reader/writer unit (not shown) or a compact disc jukebox (not shown). Although compact disc 119 is shown in a CD caddy, the compact disc 119 can be inserted directly into CD-ROM drives which do not require caddies. The computer 100 is connected to a machine 130 via a drive circuit 132. The machine 130 is configured to produce an extrusion die. The computer 100 controls the machine 130, which is, for example, a numerically controlled machine tool or the like, to produce the extrusion die.

As stated above, the system includes at least one computer readable medium. Examples of computer readable media are compact discs 119, hard disks 112, floppy disks, tape, magneto-optical disks, PROMs (EPROM, EEPROM, Flash EPROM), DRAM, SRAM, SDRAM, etc. Stored on any one or on a combination of computer readable media, the present invention includes software for controlling both the hardware of the computer 100 and for enabling the computer 100 to interact with a human user. Such software may include, but is not limited to, device drivers, operating systems and user applications, such as development tools. Such computer readable media further includes the computer program product of the present invention for determining a plurality of reference points on a contour of the opening of the extrusion die; determining sizes of a plurality of figures with same shapes corresponding to the plurality of reference points, each of the plurality of figures being inscribed in the contour of the opening and having at least one axis of symmetry, each of the plurality of figures contacting each of the plurality of reference points and at least one another point on the contour; and determining the at least one dimension of the extrusion die based on the sizes of the plurality of figures. The computer code devices of the present invention can be any interpreted or executable code mechanism, including but not limited to scripts, interpreters, dynamic link libraries, Java classes, and complete executable programs.

The method of producing, for example, an extrusion die, flow guide and chamber according to the embodiment of the present invention includes the steps of dividing each part of an opening by for example, a predetermined circle, defining the diameter of the circle as thickness, calculating the wall length of the bearing of the extrusion die and determining the shapes of a flow guide and a chamber based on this thickness, and producing an extrusion die having the calculated bearing wall length and the determined flow guide and chamber shapes, a flow guide and chamber having the determined shapes.

A flow guide shape and a chamber shape mean, for example, the cross sectional shape perpendicular to the extrusion direction.

In most cases thickness of a flow guide and a chamber are determined by the empirical rules. For example in case of a flow guide a table showing the relation between thickness and billet diameter are prepared and it can be used by the designer, and in another case to determine it calculations are conducted by using some functions derived from the empirical rules or 3 dimensional metal flow simulations.

As for the thickness of the chamber, it is calculated by considering the volume of the chamber or the cross sectional area of the port or the another factors.

Since this thickness determination method can determine thickness in an one-to-one correspondent manner and not by the judgment of a designer, the wall length of a bearing and the shapes of a flow guide and a chamber can also be determined in an one-to-one correspondent manner.

Figure 10:
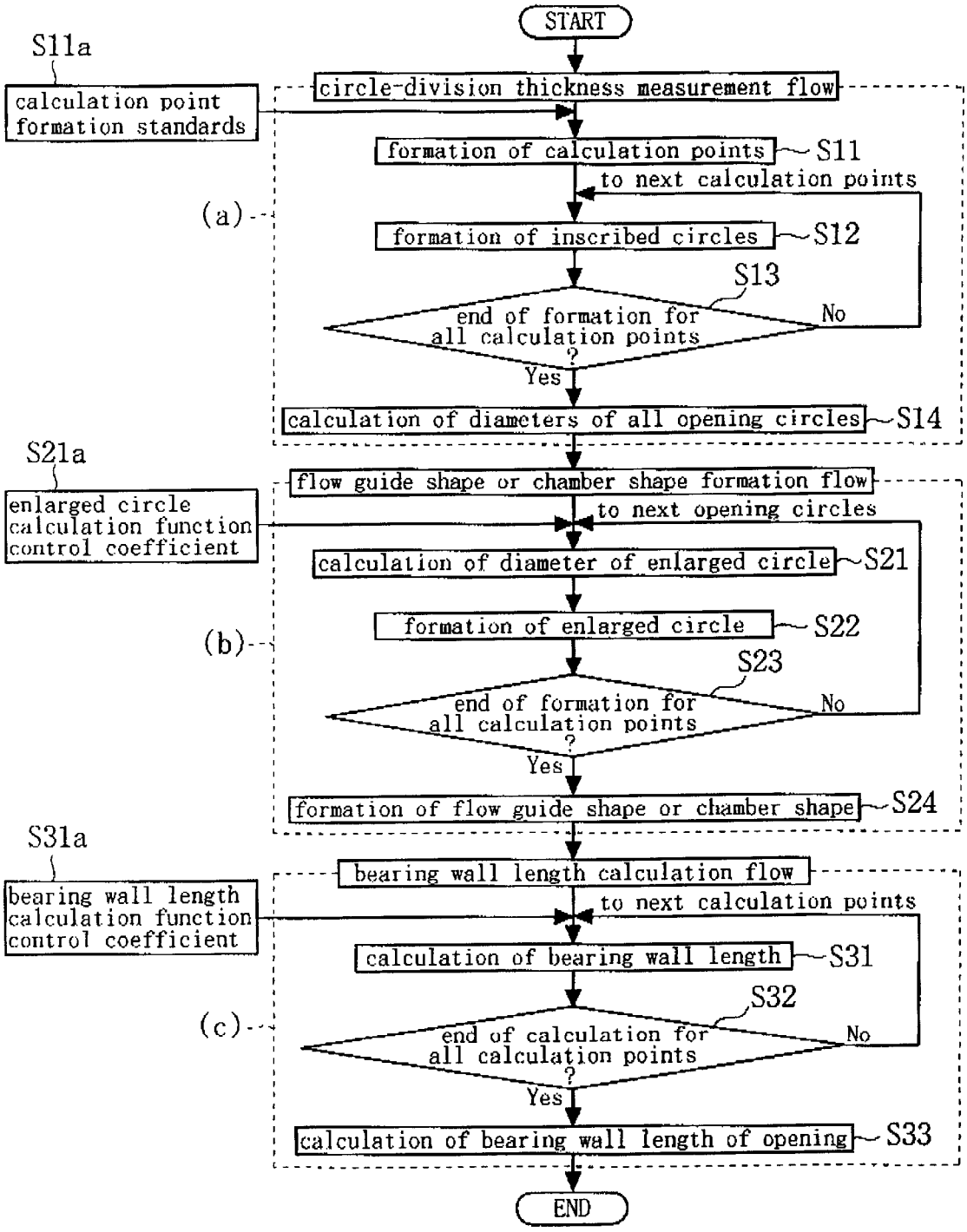
FIG. 10 is the whole of a flow chart for determining a flow guide shape or a chamber shape and the wall length of a bearing for the extrusion die of the present invention.

The steps of forming the shape of a flow guide and the steps of calculating the wall length of a bearing in the method of producing an extrusion die, flow guide and chamber according to the embodiment of the present invention are shown in FIG. 10. These steps will be described with reference to the flow charts of FIGS. 11 to 13 that are obtained by dividing FIG. 10 into three parts.

Figure 11:
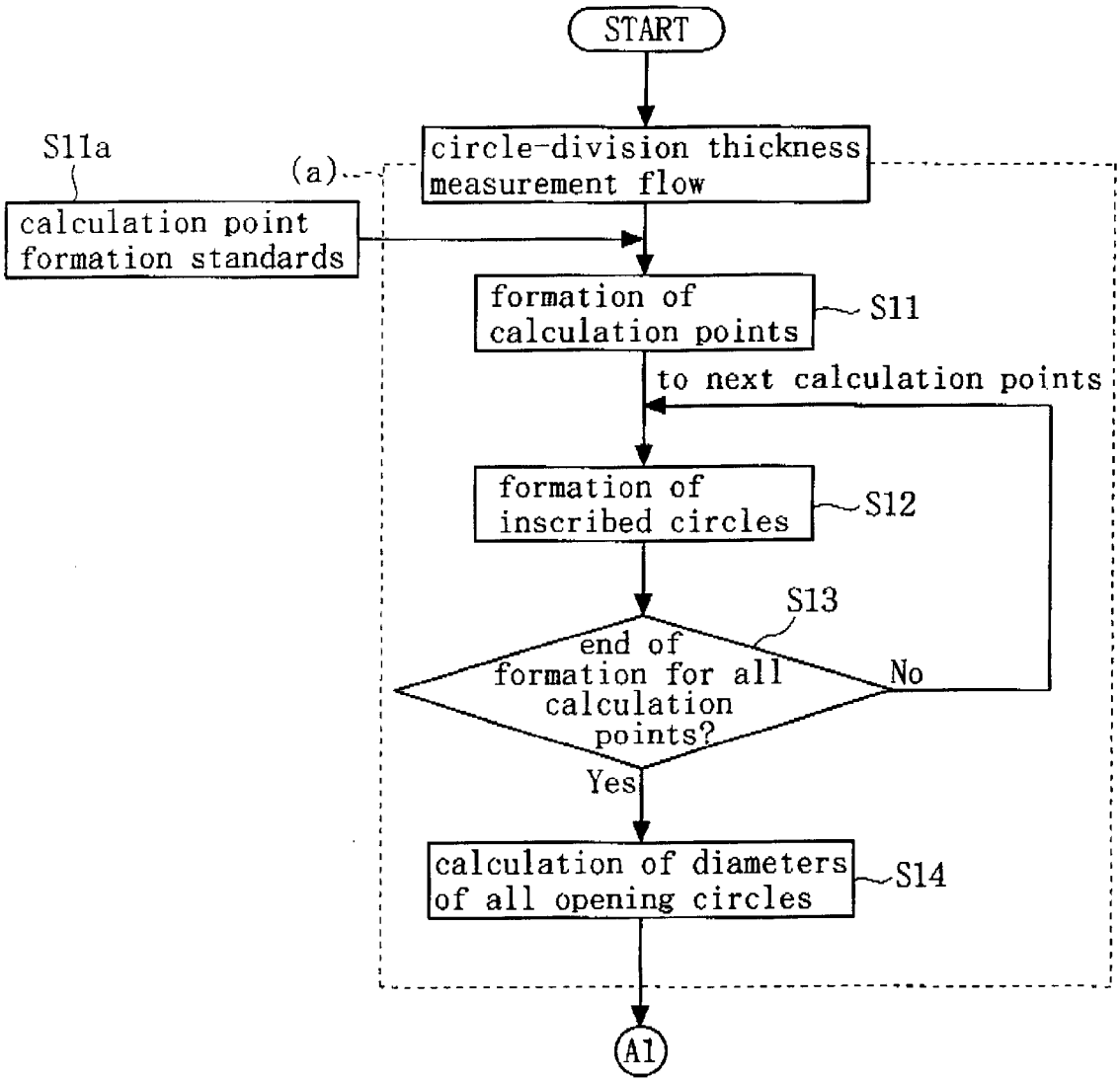
FIG. 11 is part of a flow chart for circle-division thickness measurement of the present invention.

Thickness is first measured by circle division as shown in FIG. 11. Before this thickness measurement routine is carried out, calculation points (reference points) are formed on the entire circumference of an opening (step S11). The calculation points can be formed at proper intervals by using a function based on predetermined calculation point formation standards (step S11*a*).

The intervals of the calculation points are generally about 0.5 to 3 mm, preferably 1.0 to 2.0 mm when balance between the number of times of calculation and calculation accuracy is taken into consideration. When part of the contour in concern includes a parallel line or the like, the interval for moving an inscribed figure can be adjusted within a range which does not influence the measurement result of the contour as required. Therefore, the intervals of the calculation points may be allowed to be unequal, for example, a smaller interval may be set for a portion which requires high design accuracy of an opening.

Subsequently, a circle which is inscribed in an element (line segment or circular arc) of the contour constituting an opening at two or more points including a calculation point in the opening is obtained for each calculation point (step S12). The term "inscribed circle" means a circle that contacts the contour of the opening and does not break the contour of the opening at any point. An inscribed figure that will be described hereinafter means the same as above.

Figure 27:
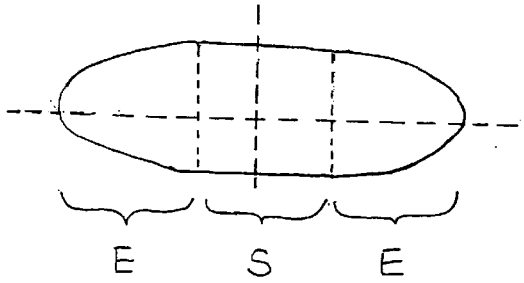
FIG. 27 is a diagram showing an example of a loop figure formed by combining U shapes.
Figure 28:
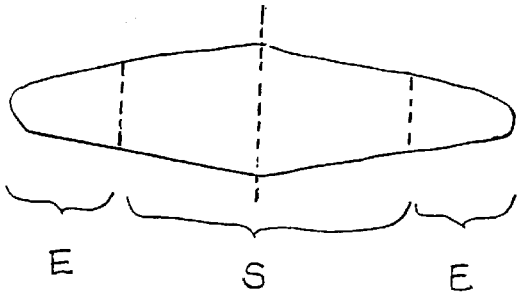
FIG. 28 is a diagram showing another example of the loop figure formed by combining U shapes.
Figure 29:
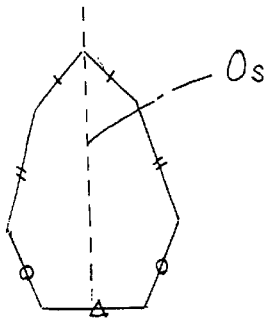
FIG. 29 is a diagram showing an example of a inequilateral polygon.
Figure 30:
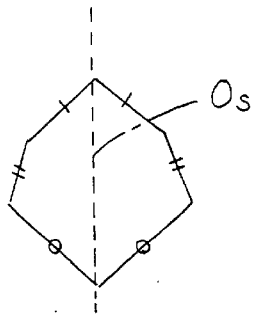
FIG. 30 is a diagram showing another example of a inequilateral polygon.

Any figures such as an ellipse, loop figure formed by combining U shapes (see FIGS. 27 and 28), regular polygon and others which can be inscribed in an ellipse or circle and whose diameter can be determined and which has symmetry to be described hereinafter can be used as the inscribed figure. Referring to FIG. 27, for example, the loop figure formed by combining U shapes includes two halves (E) of an ellipse and straight line portions (S) between the two halves of the ellipse. Referring to FIG. 28, for example, the loop figure formed by combining U shapes includes portions (E) of an ellipse and straight line portions (S) between the portions of the ellipse. As for the symmetry of an inscribed figure used for the present invention, a figure must have symmetry on at least one axis on the same plane as the figure, preferably on two axes which cross each other at a right angle. An equilateral polygon, star shape and inequilateral polygon that has symmetry on at least one axis and is inscribed in a circle are conceivable as the above figure. An inequilateral polygon includes at least one axis of symmetry and at least one pair of sides which have the same lengths, although it includes at least one side whose length is different from the length of another side. For example, reference to FIGS. 29 and 30, the inequilateral polygon has at least one axis ($O_s$) of symmetry. The ratio of the length of a piece obtained when an inscribed figure cuts the axis of symmetry as a basis to the length of a piece obtained when the inscribed figure cuts an axis which crosses the axis of symmetry at a right angle may be in the range of 0.8 to 1.2, preferably 0.9 to 1.1 for practical application. It goes without saying that a circle is most expected as an inscribed figure and in case of a circle it gives the ratio to be 1.0.

When an ellipse is used as the inscribed figure, the radius of the ellipse may be set half of its long diameter, half of its short diameter or half of the average of its long diameter and short diameter. When a regular polygon is used, a line connecting the vertex of the polygon to the center of the polygon may be defined as its radius. When a loop figure is formed by combining two U shapes, the long diameter and short diameter of the figure may be determined as in the case of an ellipse.

Further, a star shape is defined as a figure formed by connecting the outermost contours of figures formed by connecting vertexes other than the most adjacent vertexes of a regular polygon or equilateral polygon having five or more sides. Therefore, as a star figure defined herein is inscribed in a circle or ellipse, the radius of the inscribed circle or ellipse can be taken as the radius of the star shape.

Since these inscribed figures preferably have higher symmetry, when an ellipse is used as an inscribed figure, the ratio of the major axis to the minor axis of the figure is preferably a value close to 1 and when a regular polygon is used, a polygon having a large number of sides is preferred.

As described above, the diameter (size of a figure) of any figure is obtained from the radius of an inscribed figure thus obtained and the shape of an opening can be measured according to the shape of an inscribed figure in an one-to-one correspondent manner. Although any figure may be utilized as described above in order to determine dimensions of an extrusion die, a figure with the same configuration, for example, either of a circle, an ellipse or the like is utilized to determine dimensions of one extrusion die.

When the calculation points are existent on a circle or circular arc and a circle in contact with an element other than the elements of a contour which the calculation points belong to is not obtained, a circle having the same radius as a circle or circular arc which is an element of the contour which the calculation points belong to is taken as the inscribed circle. Inscribed circles at all the calculation points are obtained (step S13), the inscribed circles are specified as opening circles, and the diameter of each opening circle is defined as thickness at each calculation point (step S14).

Figure 14:
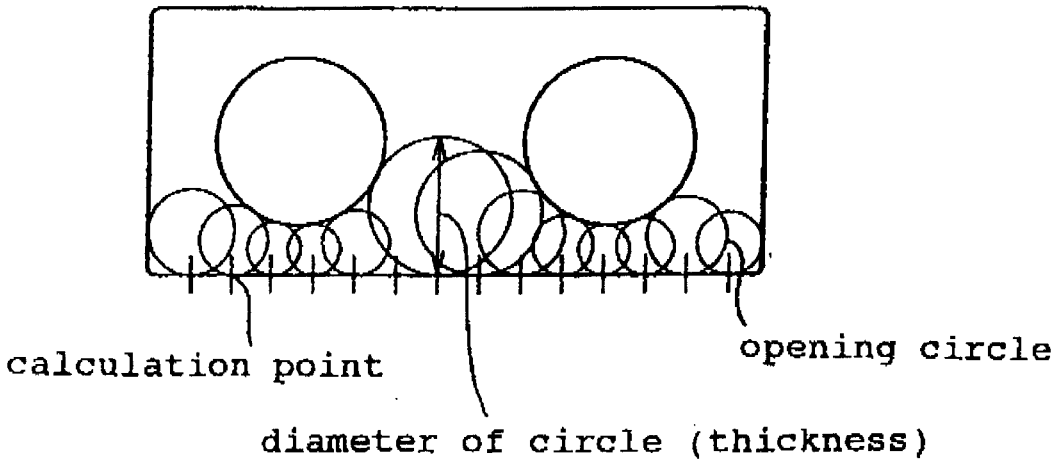
FIG. 14 is a conceptual diagram for explaining the measurement of the thickness of a product by the circle division method of the present invention.

Stated more specifically, when a product has a rectangular outer shape and two circular hollow portions as shown in FIG. 14, calculation points (part of the calculation points are shown in the figure) are specified on all female and male contours constituting the contour of the product, that is, a rectangular potion and two circular portions, and an opening circle which is contained in a contour consisting of the contour of a rectangular portion and the contours of two circles, inscribed at each calculation point and inscribed in other contour element at least one point is obtained for each calculation point. This origin of coordinate points on the contour is moved along all the male and female contours of die openings at predetermined intervals to obtain the diameter of the inscribed circle at each origin of coordinate points on the contour.

Thereby, opening circles having different diameters at all calculation points on the female and male contours are obtained as shown in FIG. 14 which shows opening circles at part of the calculation points. The diameter of an opening circle at each calculation point obtained in an one-to-one correspondent manner is measured as thickness at each calculation point.

Subsequently, the shape of a flow guide is determined from the diameters of the obtained opening circles in the case of a solid die and the shape of a chamber is obtained from the diameters of the obtained opening circles in the case of a hollow die. The shape of the flow guide (chamber) is determined by the following steps.

Figure 12:
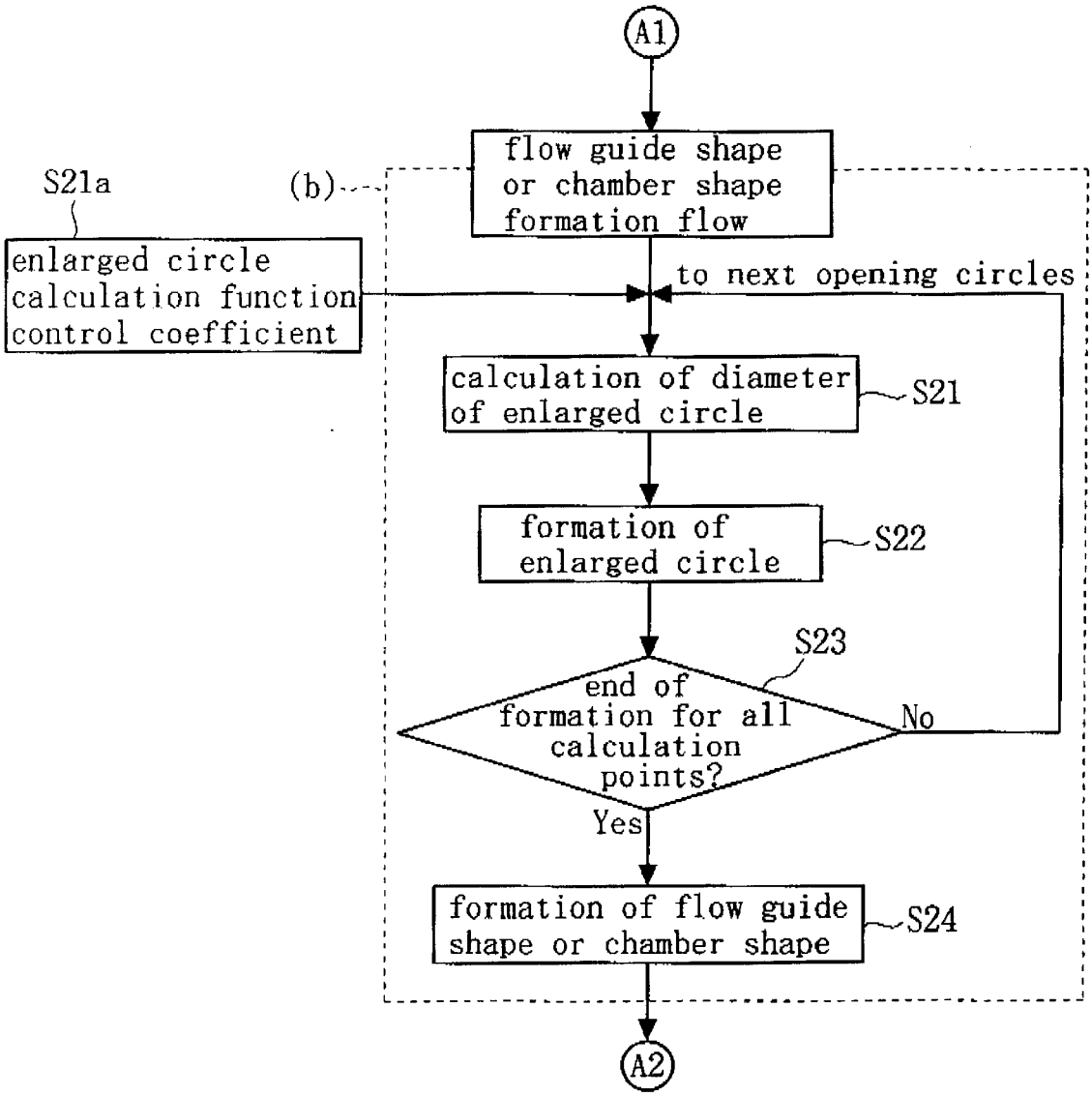
FIG. 12 is a flow chart for forming the shape of a flow guide or the shape of a chamber, following FIG. 11.

As shown in FIG. 12, the diameter of an opening circle at a specific calculation point is first enlarged to calculate the diameter of the enlarged circle of a flow guide (step S21). The size of this enlarged circle is obtained by forming a functional equation or the like based on the rules of thumb and calculating this functional equation, specifically multiplying a predetermined enlarged circle calculation function control coefficient by the diameter of the opening circle (step S21*a*).

Describing the enlarged circle calculation function used in the step S21*a* in detail, in the case of a solid die, for example, the following equation is used (in the case of a hollow die, an equation will be described in Examples).

$$D=f(X_1, X_2, X_3, L, \alpha_1, \ldots, \alpha_n) \quad \text{equation (1)}$$

D: diameter of enlarged circle of flow guide to be calculated $X_1$: diameter of opening circle to be calculated $X_2$: diameter of largest opening circle $X_3$: diameter of largest enlarged circle L: sleeve distance $\alpha$(i=1 to n): correction coefficient for optimizing approximate curve The term "largest opening circle" as used herein means the largest circle out of all the opening circles and "sleeve distance" means the distance from the center of the container of an extrusion press to each opening circle.

This functional equation is based on the rules of thumb and its behavior is changed by controlling the coefficient. The coefficient is determined empirically and the same coefficient is used in the design of all product shapes. Qualitative behavior is represented by a relational equation in which the diameter of an enlarged circle to be calculated is relatively smaller than the diameter of the largest enlarged circle of the largest opening circle.

Subsequently, an enlarged circle concentric to an opening circle at a specific calculation point is formed (step S22).

The calculation of the diameter of an enlarged circle and the formation of an enlarged circle are carried out for all the calculation points (step S23). The shape of a flow guide or chamber is formed by connecting the circumferences of the enlarged circles. That is, the shape of a contour in which all the enlarged circles are inscribed is obtained and the shape of this contour is taken as the shape of a flow guide or chamber (step S24).

Figure 15:
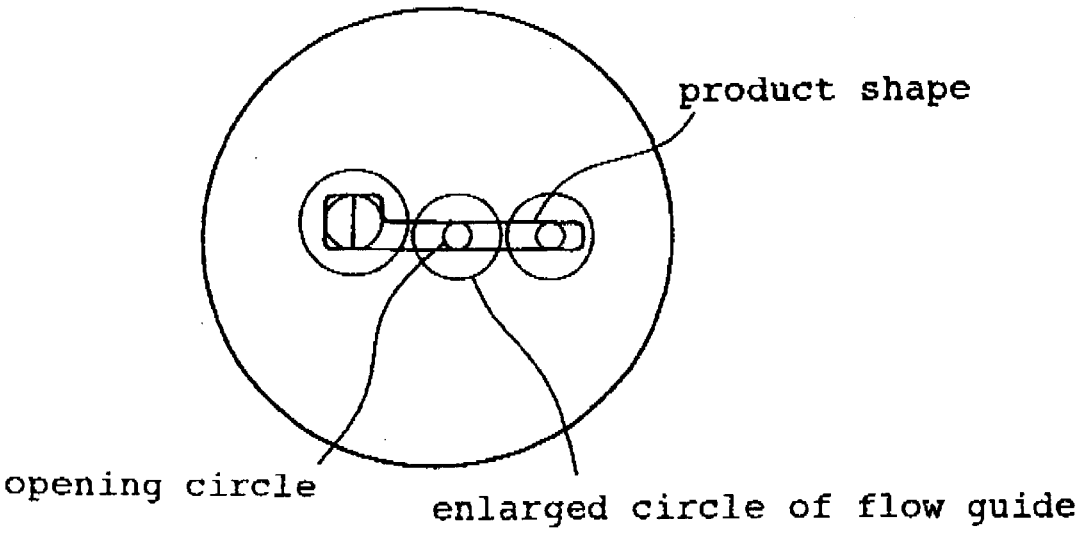
FIG. 15 is a conceptual diagram for explaining a method of forming the shape of a flow guide of the present invention.
Figure 16:
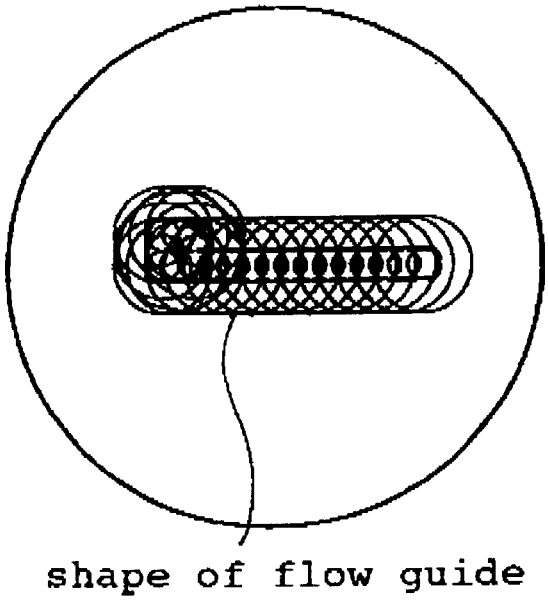
FIG. 16 is a conceptual diagram for explaining the method of forming the shape of a flow guide, corresponding to FIG. 15.

Stated more specifically, when a product having a thick portion at one end has a rectangular shape as shown in FIG. 15, an opening circle at each calculation point is obtained by the above circle-division thickness measurement routine (only three typical opening circles are shown in FIG. 15). Subsequently, an enlarged circle corresponding to each opening circle is obtained by the step S21 of calculating the diameter of an enlarged circle and the S22 of forming an enlarged circle in step S22 like the enlarged circles of a flow guide corresponding to the three opening circles shown in FIG. 15. When enlarged circles corresponding to opening circles at all the calculation points are formed, a large number of enlarged circles are formed in an opening portion as shown in FIG. 16 and a contour in which all the enlarged circles are inscribed is obtained as the shape of a flow guide.

When the formation of the shape of a flow guide or chamber is completed as described above, the wall length of a bearing is calculated. The calculation of the wall length of a bearing is carried out by the following steps.

Figure 13:
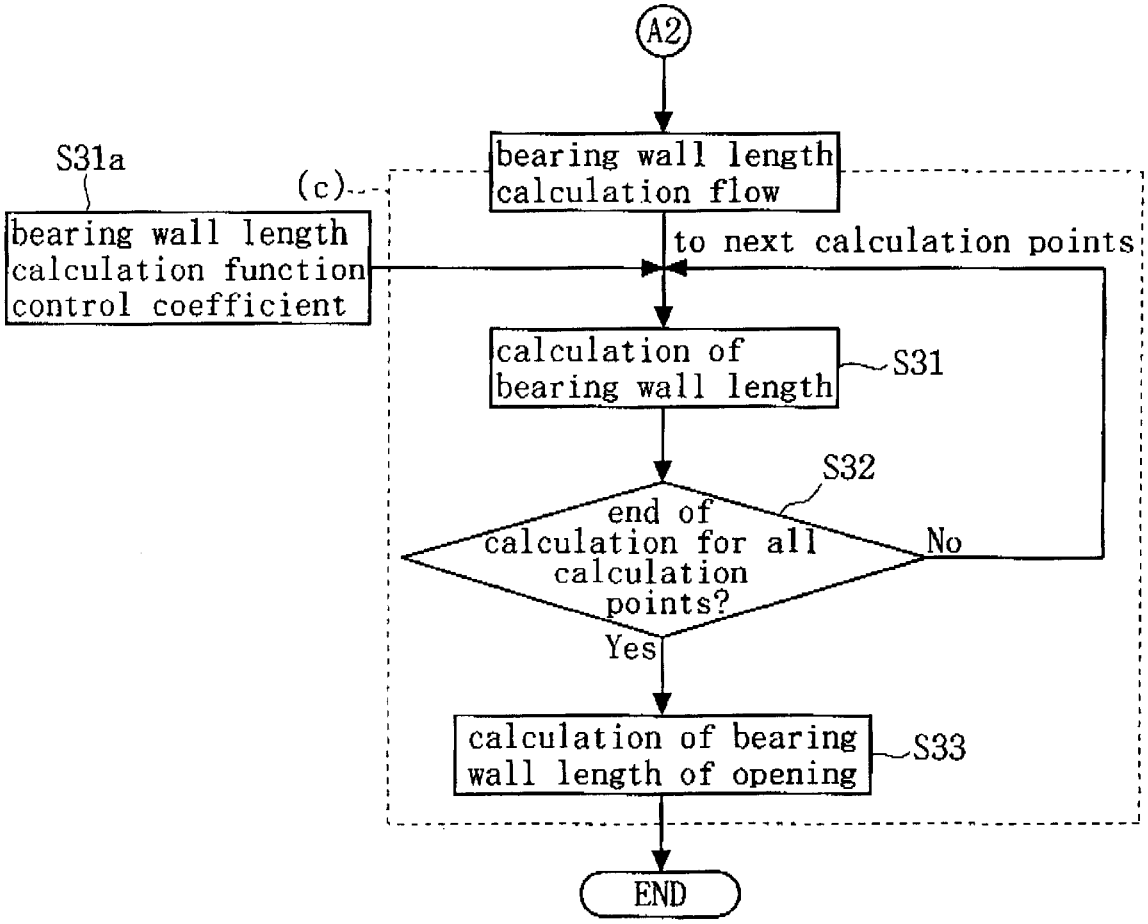
FIG. 13 is a flow chart for the calculation of the wall length of a bearing, following FIG. 12.

As shown in FIG. 13, a functional equation based on the rules of thumb is first formed using factors related to the wall length of a bearing as variables on the basis of the diameter of an opening circle at a specific calculation point (step S31*a*), and the wall length of a bearing at the specific calculation point is obtained by this functional equation (step S31). Then, the wall lengths of a bearing at all the calculation points are obtained (step S32) and the length of a bearing for the shape of a product is calculated.

Describing the functional equation for obtaining the wall length of a bearing used in the step S31*a* in detail, in the case of a solid die, for example, the following functional equation is used.

$$L_b=f(X_1, X_2, X_3, L, A, \beta_1, \ldots \beta_n) \quad \text{equation (2)}$$

$L_b$: wall length of bearing to be calculated $X_1$: diameter of opening circle to be calculated $X_2$: diameter of enlarged circle of opening circle to be calculated $X_3$: diameter of largest opening circle L: sleeve distance A: alloy coefficient $\beta$(i=1 to n): correction coefficient for optimizing approximate curve This functional equation is based on the rules of thumb as in the case of a flow guide and its behavior is changed by controlling the coefficient $\beta$. The coefficient $\beta$ is determined empirically and the same coefficient is used in the design of all product shapes. The qualitative behavior of this functional equation is represented by a relational equation obtained by combining relationships shown in Table 1 below.

TABLE 1

| | | | |
|---|---|---|---|
| wall length of bearing | Long | → | short |
| diameter of opening circle | Large | → | small |
| sleeve distance | close to center of container | → | far from center of container |
| alloy | soft alloy series | → | hard alloy series |

Thereafter, known bearing blending is carried out based on the wall lengths of a bearing obtained at all the calculation points as required and the wall lengths of a bearing which is continuous on the entire contour of the opening is calculated (step S33). The term "bearing blending" as used herein means connection between the wall length of the bearing at a certain calculation point and the wall length of the bearing at a calculation point adjacent to the above calculation point to determine the final shape of the bearing from the calculated values of the wall length of the bearing.

Since the circle-division thickness measurement method of the present invention used to obtain the shape of the flow guide and the wall length of the bearing of an extrusion die is carried out based on specific rules as described above, it is easy to form a CAD program and perfect standardization is made possible through automation by incorporating this method into a CAD program. Therefore, this method can improve reproducibility in the design of an extrusion die or flow guide and prevent differences in the design of an extrusion die which occur in the thickness measurement by judgment by a designer.

Further, the measurement of thickness having practical applicability can be automated by using the above circle-division thickness measurement method. The present invention is not merely new methodology for die design but is characterized in that it well matches the basic principle of conventional die design and the results of the design are obtained for any product shape in an one-to-one correspondent manner.

Figure 17:
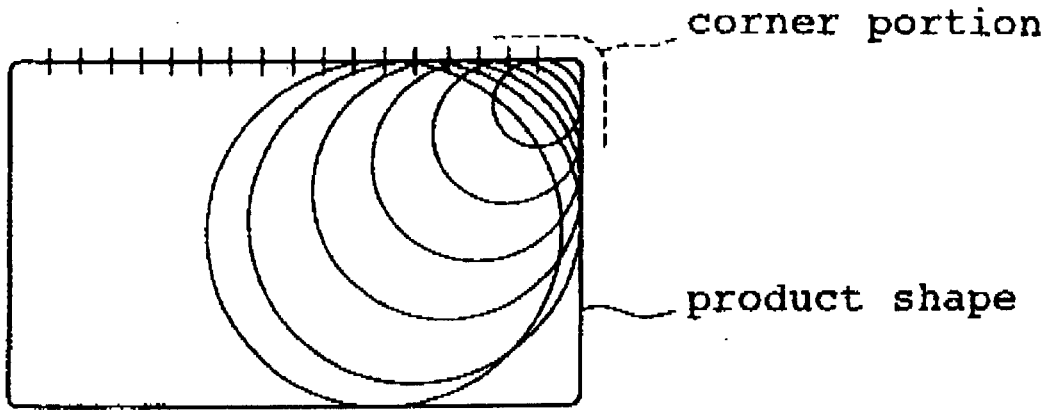
FIG. 17 is a conceptual diagram for explaining that the thickness of a corner portion of a product (diameter of an opening circle) becomes small.

It is understood from the design of an extrusion die having a shape shown in FIG. 17, for example, that this thickness measurement method is useful for the design of the bearing of an extrusion die. That is, opening circles at calculation points specified on a parallel straight line on a rectangular contour shown in FIG. 17 do not cause a problem in the design of a bearing as in the prior art design method but the diameters of opening circles at four corner portions which are each a circular arc having a small diameter are extremely small, making it possible to design a bearing according to a sharp change in thickness.

In fact, the corner portions of the contour shown in FIG. 17 are each sandwiched between two friction surfaces and the flowability of a metal becomes worse. Therefore, the wall length of a bearing must be made relatively small. Meanwhile, the opening circle of each corner portion shown in FIG. 17 is much smaller than opening circles of other portions with the result that the thickness of each corner portion is measured as small. Therefore, it is understood that the thickness of the corner portion agrees with the phenomenon of the actual metal flow.

That is, it is possible to design a bearing according to a change in thickness by setting the wall length of a bearing according to the diameter of a circle even for an opening portion having a contour formed by a combination of straight lines not being parallel, a straight lines and a circular arcs, etc. and circular arcs which easily produce design differences in the prior art. Therefore, the design of an extrusion die which requires the proper design of an extruded metal flow can be realized by using the bearing wall length determination method according to the above embodiment of the present invention.

The above thickness measurement routine ((a) of FIG. 10), the flow guide shape or chamber shape formation routine ((b) of FIG. 10) and the bearing wall length calculation routine ((c) of FIG. 10) are incorporated in a CAD program which is a tool for designing an extrusion die, flow guide or chamber, and an extrusion die, flow guide or chamber is produced by executing these routines on the program so as to achieve the determined bearing wall length, flow guide shape or chamber shape. An extrusion press described with reference to FIG. 1 is assembled using this extrusion die, flow guide or chamber so that extrusion capable of controlling a metal flow properly can be carried out by using this extrusion press.

To design and produce a hollow die which is an extrusion die having a hollow portion, design which is a little different from when the shape of a flow guide is formed is carried out at the time of forming the shape of a chamber.

Stated more specifically, in steps S21 to S24 of FIG. 12, the shape of a chamber is formed by the same process. An opening circle is not enlarged keeping concentricity in the formation of an enlarged circle but when it contacts a mandrel shown in FIG. 20 (projection for forming a hollow portion), the shape of a chamber is formed by enlarging the circle in a normal direction from its contact point with the mandrel until it contacts the circumscribed circle of a port portion.

The above thickness measurement routine ((a) of FIG. 10), the flow guide shape or chamber shape formation routine ((b) of FIG. 10) and the bearing wall length calculation routine ((c) of FIG. 10) do not always need to be carried out in the order named. It is needless to say that after the thickness measurement routine (a) is carried out, the bearing wall length calculation routine (c) may be carried out, followed by the flow guide shape or chamber shape formation routine (b).

EXAMPLES

To produce a hollow die (an extrusion die having a hollow portion) as an example of the present invention, the determination of the shape of a chamber (flow guide) and the wall length of a bearing using the method of the present invention will be descried hereinunder.

Stated more specifically, the shape of the chamber and the wall length of the bearing of the hollow die are determined by the following steps.

In the example of the present invention, a program for automatically executing a flow chart shown in FIGS. 11 to 13 is incorporated in the CAD system of a computer.

Figure 18:
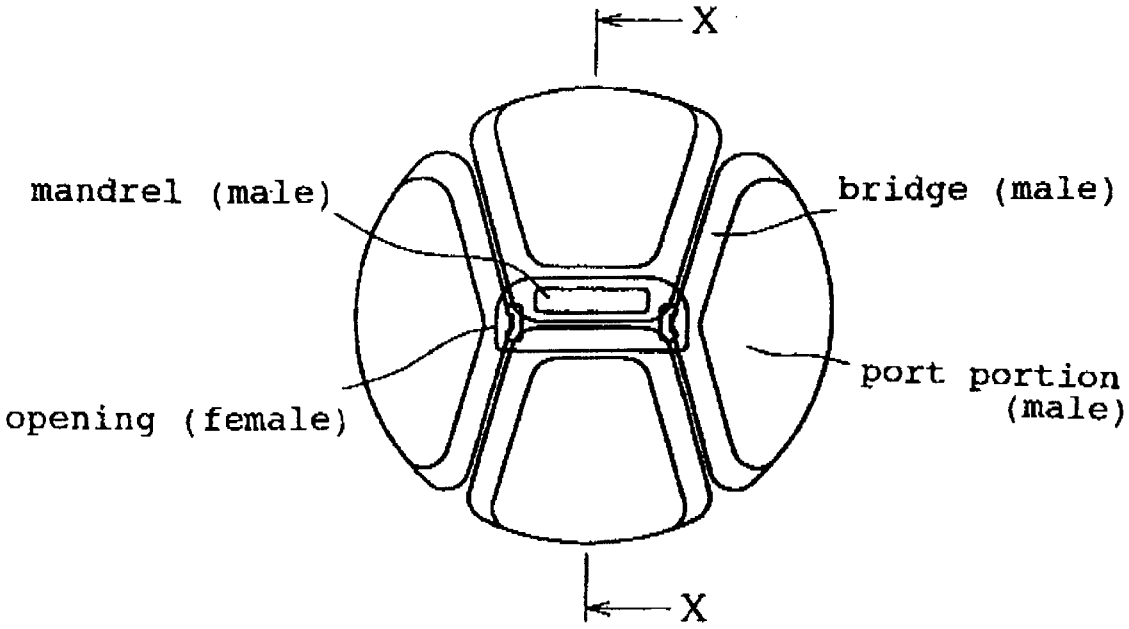
FIG. 18 is a structural diagram showing a hollow die designed by the prior art and used in an embodiment of the present invention.
Figure 20:
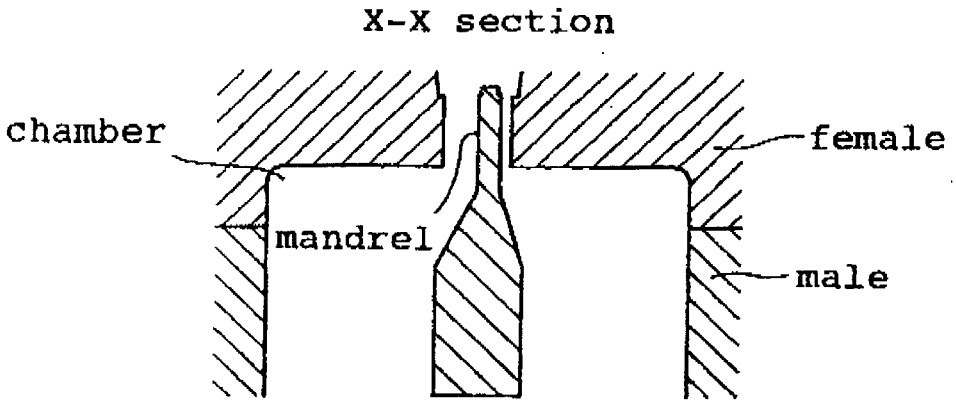
FIG. 20 is a X—X sectional view of the hollow die of FIG. 18.

An operator for designing an extrusion die and chamber carries out various designs related to the hollow die on the CAD system before he/she executes the program of the example and finally completes the drawing of a die shape shown in FIG. 18. FIG. 20 shows the section of FIG. 18. The expression "various designs" as used herein means designs such as the corrections of openings, the layout (arrangement) of the openings, the arrangement of the bridges of a male die and the shape of a port portion in consideration of heat shrinkage, the deflection of a die and the like.

After the drawing of a die shape is completed, the operator executes the automation program of the example and specifies a port area. The port area is a portion surrounded by the outer boundary and the boundaries between ports and used to measure the distance between the opening circle and the gravity center of the port portion in automatic design.

Thereafter, circle-division thickness measurement, chamber shape formation and bearing wall length calculation are carried out automatically by a program incorporated in a computer by the steps shown in FIGS. 11 to 13 without the operator.

Figure 21:
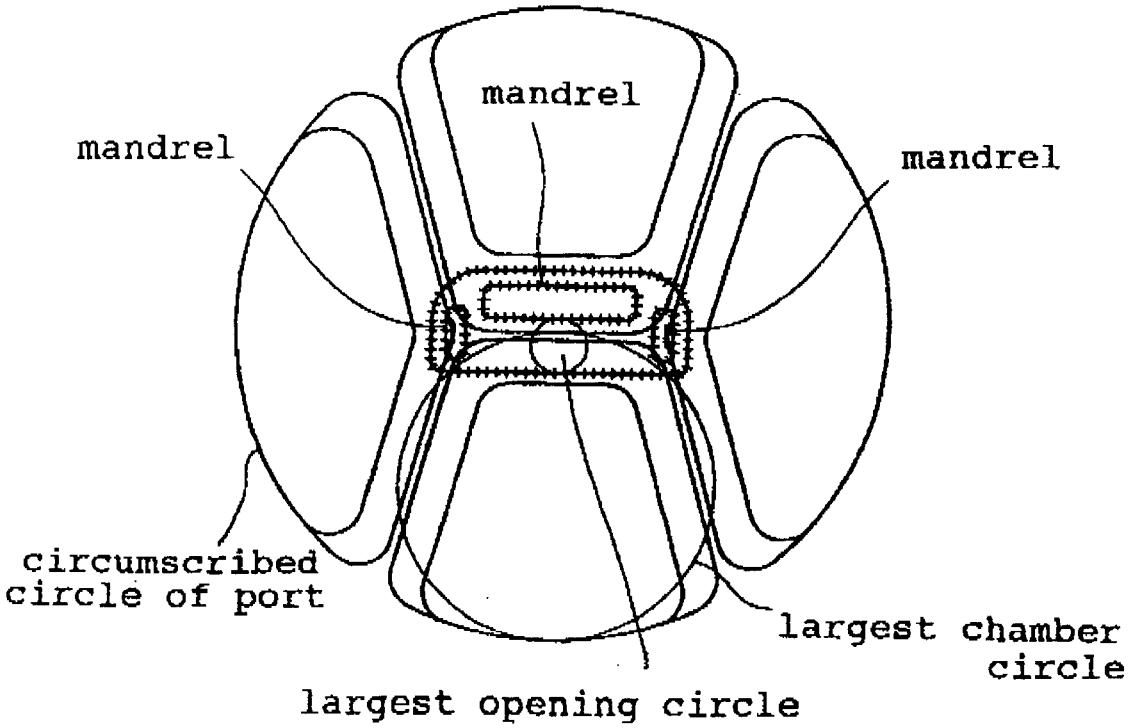
FIG. 21 is a diagram for explaining the calculation points, the largest opening circle and the largest chamber circle of a hollow die used in the embodiment of the present invention.

Describing each processing specifically, in the processing of circle-division thickness measurement, calculation points are formed on the entire circumference of a contour forming an opening at appropriate intervals as shown in FIG. 21. In this example, the calculation points are formed at intervals of 2 mm and calculation points are also formed on the entire circumference of a mandrel that is an inner shape.

Opening circles are formed at all the calculation points (only an opening circle at one typical calculation point is shown in FIG. 21). At this point, the largest opening circle is stored and specified as the largest opening circle (maximum thickness) for use in calculations, which will be described hereinafter.

Subsequently, as for the design of a chamber, as shown in FIG. 21, the largest opening circle is enlarged until it is inscribed in the circumscribed circle of a port. When the opening circle is enlarged while keeping concentricity and contacts the mandrel, it is enlarged from its contact point with the mandrel in a normal direction. This enlarged circle is specified as the largest chamber circle and the diameter of this circle is stored. Thereafter, the processing of forming chamber enlarged circles for all the opening circles is carried out. To carry out this enlargement processing, the following functional equation obtained by the rules of thumb as in the equation (1) is used to enlarge a chamber circle until it achieves a diameter obtained from the functional equation as in the enlargement of the largest opening circle. The equation (1) used for a solid die and the equation (3) used for a hollow die differ from each other due to differences in shape and characteristic properties between these dies.

$$D=f(X_1, X_2, X_3, L, \alpha_1, \ldots \alpha_n) \qquad \text{equation (3)}$$

Figure 19:
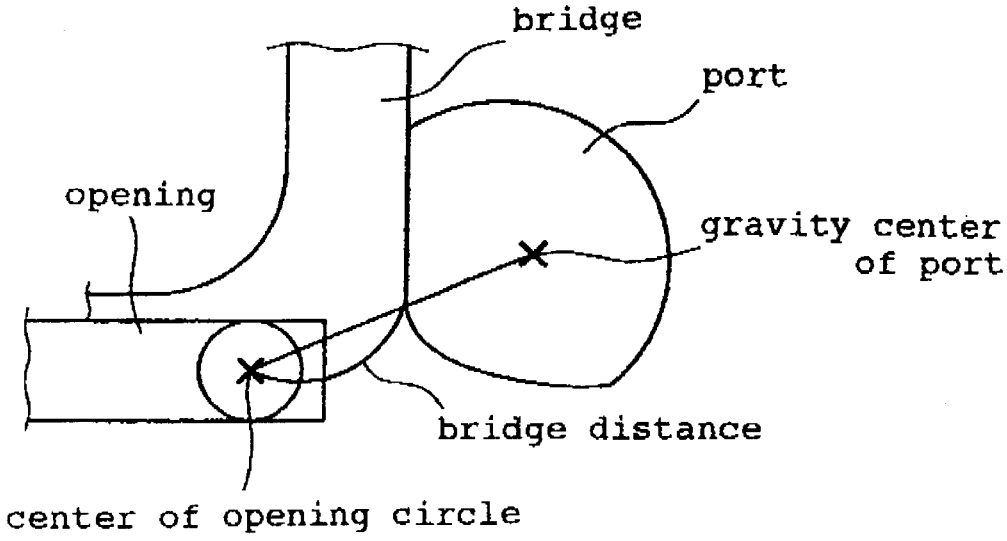
FIG. 19 is a partly enlarged view for explaining bridge distance.

D: diameter of enlarged chamber circle to be calculated $X_1$: diameter of opening circle to be calculated $X_2$: diameter of the largest opening circle $X_3$: diameter of the largest chamber circle L: bridge distance $\alpha$(i=1 to n): correction coefficient for optimizing approximate curve As shown in FIG. 19, the term "bridge distance" as used herein means the distance from the center of each opening circle to the end point of the bridge in a direction of the gravity center of the port.

Figure 22:
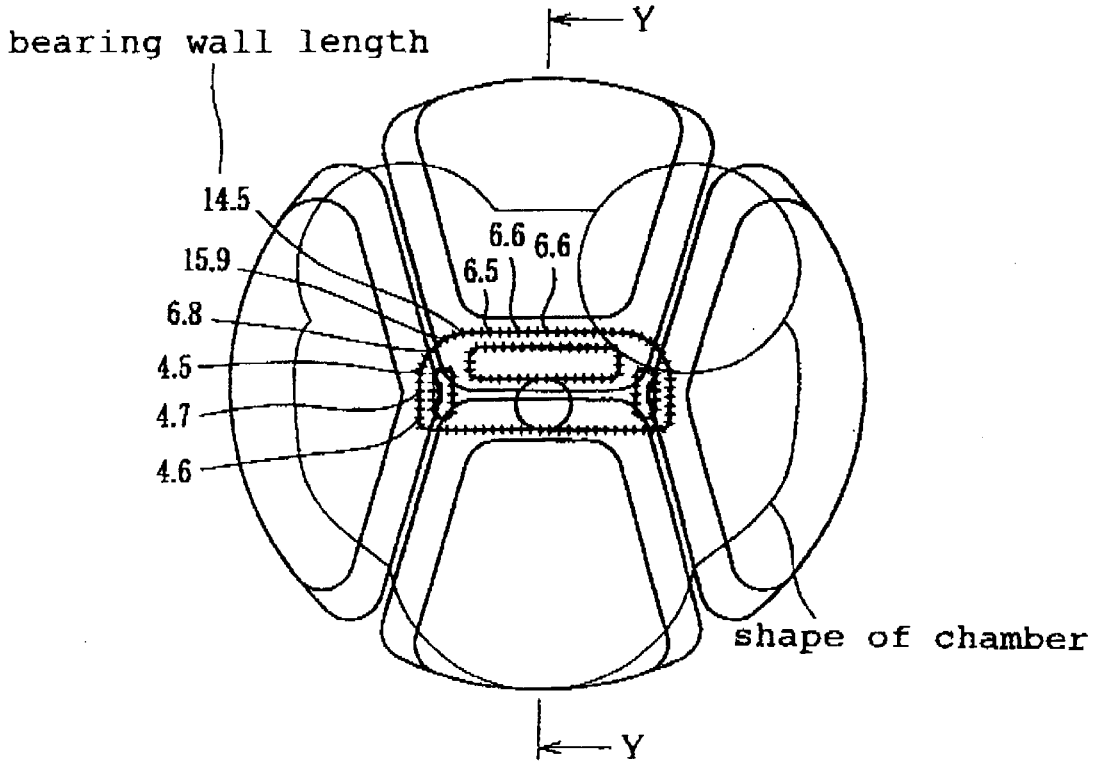
FIG. 22 is a diagram for explaining a method of determining the shape of a chamber and the wall length of the bearing of the hollow die of the present invention.

When a contour which all chamber circles corresponding to the opening circles are inscribed in is obtained after the end of the processing of enlarging all the opening circles, a chamber shape as shown in FIG. 22 is obtained.

Subsequently, the calculation of the wall length of a bearing for the hollow die of this example is carried out. For the calculation of the wall length of a bearing, the following functional equation based on the rules of thumb as in the equation (2) is used based on the diameter of an opening circle at each calculation point. The equation (2) used for a solid die and the equation (4) used for a hollow die differ from each other due to differences in shape and characteristic properties between these dies.

$$L_b=f(X_1, X_2, X_3, L, A, M, \beta_1, \ldots \beta_n) \quad \text{equation (4)}$$

$L_b$: wall length of bearing to be calculated $X_1$: diameter of opening circle to be calculated $X_2$: diameter of chamber circle of opening circle to be calculated $X_3$: diameter of largest opening circle L: bridge distance A: alloy coefficient M: contact section (whether opening circle contacts mandrel or not)

$\beta$(i=1 to n): correction coefficient for optimizing approximate curve

This functional equation is based on the rules of thumb as in the case of a chamber shape and its behavior is changed by controlling the coefficient $\beta$. The coefficient is determined empirically and the same coefficient is used in the design of all product shapes. The qualitative behavior of this functional equation is represented by a relational equation obtained by combining relationships shown in Table 2 below.

TABLE 2

| | | | |
|---|---|---|---|
| wall length of bearing | Long | → | short |
| diameter of opening circle | Large | → | small |
| bridge distance | close to gravity center of port | → | far from gravity center of port |
| alloy | soft alloy series | → | hard alloy series |
| contact of opening circle | not in contact with mandrel | → | in contact with mandrel |

Figure 23:
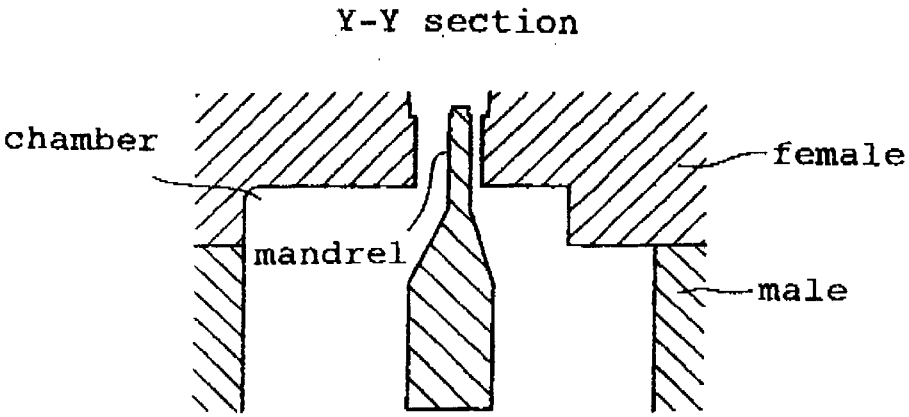
FIG. 23 is a Y—Y sectional view of the hollow die of FIG. 22.

As is obvious from the sectional views of FIG. 23 and FIG. 20, it is seen that the hollow die shown in FIG. 22 and the hollow die of the prior art shown in FIG. 18 each having a chamber shape obtained as described above differ from each other in sectional shape (in FIG. 23 and FIG. 20, as a mandrel only a central mandrel is shown). That is, it is understood that the hollow die designed in this example has a chamber shape that differs according to an opening shape unlike the hollow die designed by the prior art. More specifically, the hollow die designed in this example has a narrow chamber area on a narrow side of the outlet area (right side of the mandrel in the figure) and can reduce a metal flow as obvious from FIG. 23 whereas the hollow die of the prior art cannot control a metal flow.

Thereafter, a hollow die having a chamber shape and a bearing wall length determined by the above steps and a hollow die having a chamber shape and a bearing wall length determined by the design method of the prior art are produced for the same product shape and the dimensional values of products extruded using these are compared and shown in Table 3 below.

TABLE 3

| measure site | data section | design of the prior art | design of this example |
|---|---|---|---|
| portion P | end of first billet | 15.52 | 15.12 |
| | end of fifth billet | 15.21 | 14.93 |
| | average | 15.27 | 15.03 |
| | standard deviation | 0.12 | 0.08 |
| portion Q | end of first billet | 53.94 | 53.76 |
| | end of fifth billet | 53.16 | 53.33 |
| | average | 53.36 | 53.53 |
| | standard deviation | 0.34 | 0.19 |

As obvious from the measurement results of Table 3, according to extrusion results obtained when the hollow die of this example is used, a metal flow is controlled properly by a hollow die having an appropriate bearing wall length and having a chamber of an appropriate shape. Therefore, it is understood that a chamber having a uniform shape is formed only for the purpose of welding a metal and that an extruded product has satisfactory dimensional values compared with the case where the hollow die of the prior art having a bearing wall length designed by a design method which is not one-to-one correspondent is used.

Figure 24:
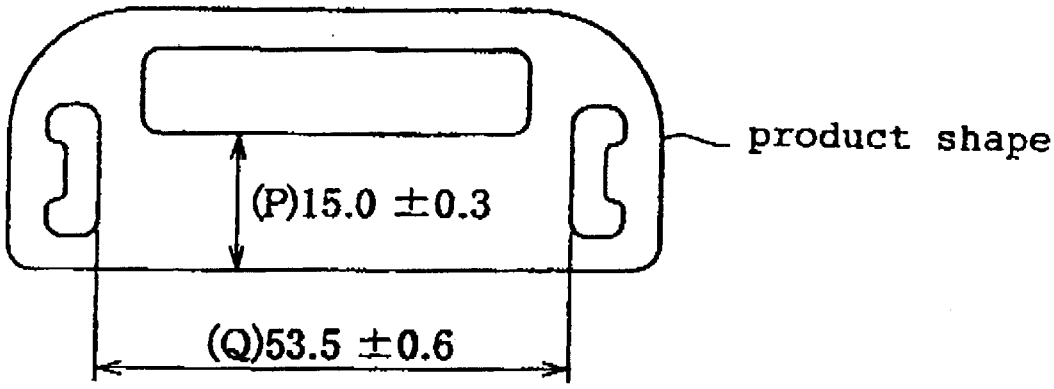
FIG. 24 is a diagram showing the shape of a product and the permissible size of the product in the embodiment.

That is, the size of a product produced using the hollow die of this example has a small standard deviation and is within permissible ranges shown in FIG. 24 compared with a product produced using the hollow die of the prior art. Thus, it is seen that the product has higher quality than the product produced using the hollow die of the prior art. It is considered that this is because the flow rate at the outlet and a pressure difference in the chamber are made more appropriate by the proper control of a metal flow.

The proper control of a metal flow by means of a chamber shape is effective for a product shape having a thickness difference as shown in this example because the bending of the mandrel caused by, for example, a pressure difference of a metal in the chamber generally causes a problem. The same can be said of other product shapes though there are differences in contribution rate among them.

Extruded products are various in shape and it is extremely difficult to derive the rules of determining shapes more fitted to all product shapes with the prior art method of determining a chamber shape. Therefore, when the control of a chamber based on empirical judgment without one-to-one correspondent determination rules as in the prior art is carried out, the repeatability of design is low and the number of control factors in the design of a die increases, thereby causing differences in the design of a die and an increase in the number of steps for the correction of the die.

The method of determining, for example, a chamber shape and a flow guide shape and a bearing wall length, being applied by the figure dividing method, for example, the circle dividing method, of the present invention, is to divide a product shape into elements by figures, for example, opening circles and has such merits that a model can be simplified and the formation of a relational equation based on the rules of thumb is made easy by substituting a whole complicated product shape by figures, for example, circles at calculation points.

Therefore, when the method of determining, for example, a chamber shape and a flow guide shape and a bearing wall length of the present invention are used , the control of a chamber shape and a flow guide shape will be applicable in the design of all dies by controlling the coefficient of a relational equation which integrates the rules of thumb, and an extrusion die, flow guide and chamber capable of controlling a metal flow properly based on this can be produced.

In consideration of a large number of extruded product shapes, it has been difficult to reduce differences in the design of an extrusion die with the prior art method of determining a chamber shape and a bearing wall length. However, the design of an extrusion die having perfect reproducibility can be made possible by using the method of determining a chamber shape and a bearing wall length of the present invention.

An example where the present invention is applied to a solid die will be described hereinunder. A die designed by the prior art and a die designed by the present invention are produced for a product shape shown in FIG. 25 and extruded products produced using these dies are compared. Since the product is wide and unsymmetric in shape, a wavy pattern (phenomenon that a portion having a fast flow rate of a metal supply excess metal to compare with other portions and as a results it makes a product becomes wavy) is easily formed in the section of the product or deformation easily occurs at the time of extrusion due to nonuniformity in the flow rate of a metal at each portion, which is one of the products having, higher difficulty in extrusion.

Figure 25:
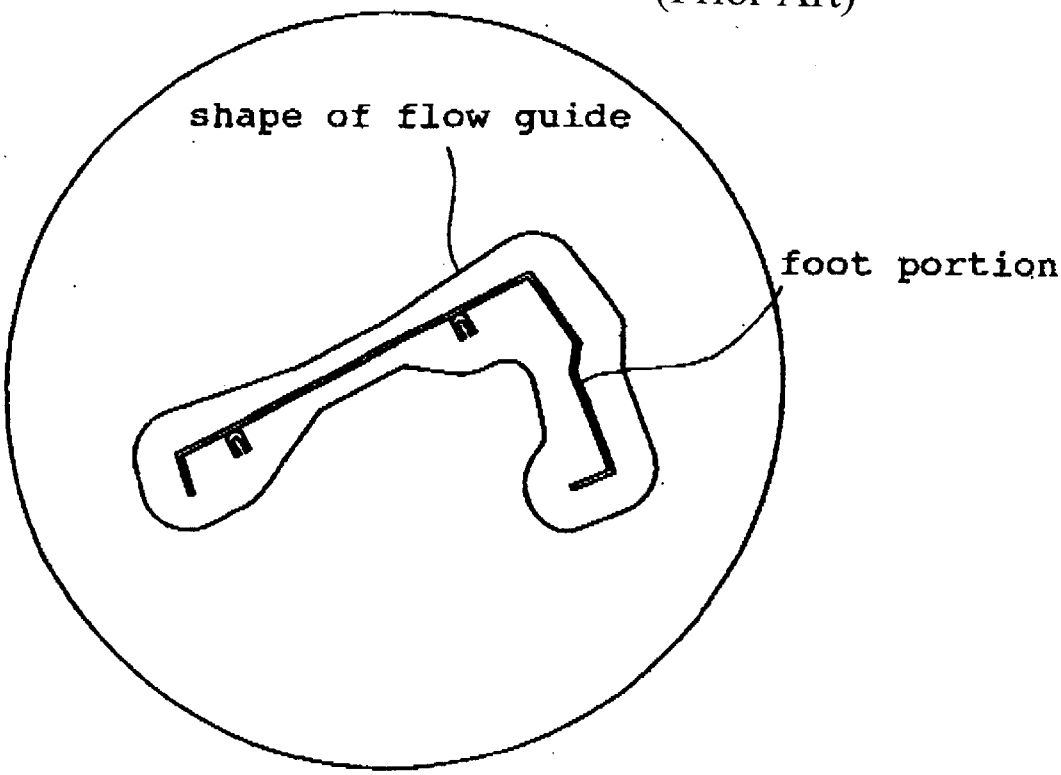
FIG. 25 (Prior Art)
FIG. 25 is a diagram showing the shape of a flow guide designed by the prior art.
Figure 26:
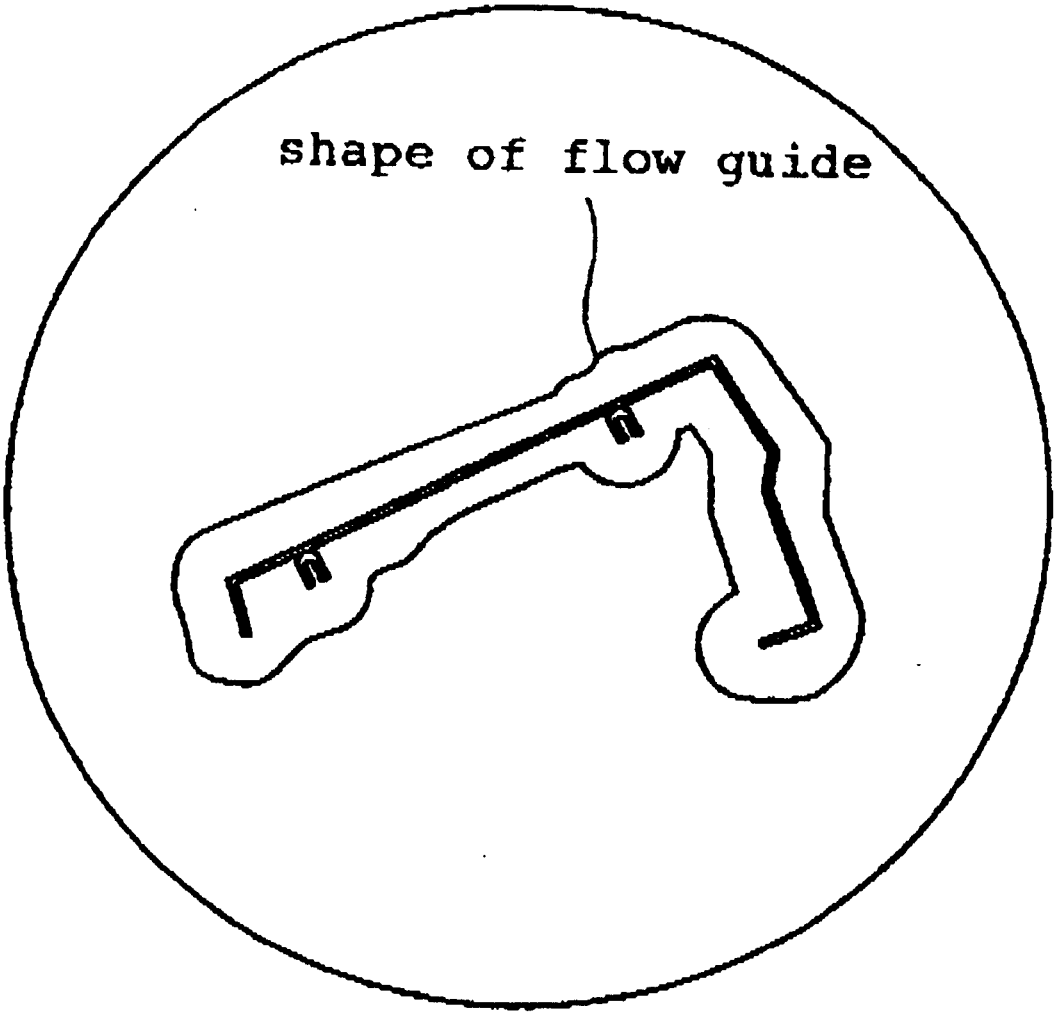
FIG. 26 is a diagram showing the shape of a flow guide designed by the present invention.

The shape of a flow guide designed by a conventional is shown in FIG. 25 and the shape of a flow guide designed by the present invention is shown in FIG. 26. The conventional design is carried out by a designer based on his/her experience and the design of the present invention is carried out by the solid die design steps shown in the embodiment of the present invention.

As for the results of extrusion, the die designed by the conventional method forms waves in a foot portion shown in FIG. 25 at the time of extrusion and needs to be corrected later whereas the die of the present invention is free from product waves and deformation at the time of extrusion, obtains good extrusion results and does not need to be corrected in operation.

In both the conventional design shown in FIG. 25 and the design of the present invention shown in FIG. 26, the width of a flow guide at the center of a container where a metal easily flows is reduced. The conventional design is based on the experience of a designer and does not take into consideration the thickness and position relative to the container of each opening portion in the opening shape (outlet shape) of a die. Therefore, the results of extrusion show that the flow guide at the center of the container is designed to be too narrow for the product. On the other hand, in the design of the present invention, the flow guide is designed such that the thickness of each portion of the product and the sleeve distance shown in the equation (1) of the embodiment are determined for all the opening circles in an one-to-one correspondent manner with the result that the total balance of the flow rate of a metal is good and size and shape inconvenience at the time of extrusion can be reduced by using the present invention.

When the product of this example (FIG. 25) is re-designed without no prior information, it is difficult to make the design of the prior art completely the same as the design of this example. However, since the design of the present invention is automated using an one-to-one correspondent circle dividing method, all the designs become the same and the ratio of products which pass inspection at the time of extrusion can be increased for all the shapes of extruded products by making appropriate the coefficient of a relational equation used in the design compared with that of the design of the prior art.

Further, when extrusion die design inconvenience is to be improved, it is difficult to change design standards thoroughly in the prior art whereas only the coefficient must be changed in the present invention, thereby making it possible to change extrusion die design standards thoroughly with a small number of steps.

As described above, the present invention has two big features different from those of the prior art. That is, (1) a contour is measured with figures, for example, circles, polygons or the like, whereby a metal flow at an arbitrary position of a bearing in not only a thickness direction but also a direction perpendicular to the direction can be reflected upon the design of a bearing. (2) To measure a space constituting the section of an extruded product and to convert it into a function which is the basis of a bearing wall length, a reference line is not used thereby providing freedom to the design of a die.

Thanks to these features, even in the case of a complicated product shape having a totally unsymmetric sectional shape such as an ameba-like shape, it is possible to measure the sectional shape of an extruded product in an one-to-one correspondent manner without defining a special reference line, thereby making it easy to automate die design and promoting design standardization. In the present invention, the design of an extrusion die, flow guide, chamber or the like capable of controlling a metal flow properly, which makes possible standardization and is effective in improving the dimensional accuracy of an extruded product, is realized.

Although a dimension of an extrusion die is determined by and the machine tool is controlled by a computer in the above-described embodiments, the dimension of the extrusion die may be determined and the machine tool may be controlled without using a computer.

As having been described above, in the extrusion die production method of the present invention, a die opening shape is measured one-to-one correspondent to inscribed figures for any product shape, and an extrusion die is designed and produced according to the measured contour based on this measured shape in an one-to-one correspondent manner. Therefore, the method can produce an extrusion die which can stabilize quality such as the size and shape of a product.

Further, design time can be shortened by the automation of die design and the delivery time of an extruded product is shortened by the stabilization of size, shape, etc.

What is claimed as new and is desired to be secured by Letters Patent of the United States is:

1. A method of determining at least one dimension of an extrusion die including an opening through which material is extruded, comprising:

determining a plurality of reference points on a contour of the opening of the extrusion die;

determining sizes of a plurality of figures with same shapes corresponding to the plurality of reference points, each of the plurality of figures being inscribed in the contour of the opening and having at least one axis of symmetry, each of the plurality of figures contacting each of the plurality of reference points and at least one another point on the contour; and determining the at least one dimension of the extrusion die based on the sizes of the plurality of figures.

2. A method according to claim 1, wherein the plurality of reference points are determined according to a predetermined function.

3. A method according to claim 1, wherein the plurality of reference points are determined such that intervals between adjoining two points of the plurality of reference points are substantially equal.

4. A method according to claim 1, wherein the plurality of reference points are determined such that intervals between adjoining two points of the plurality of reference points vary.

5. A method according to claim 4, wherein the intervals are shorter as a portion of the contour of the opening requires higher accuracy.

6. A method according to claim 1, wherein the plurality of reference points are determined such that intervals between adjoining two points of the plurality of reference points are substantially from 0.5 mm to 3.0 mm.

7. A method according to claim 6, wherein the intervals are substantially from 1.0 mm to 2.0 mm.

8. A method according to claim 1, wherein each of the plurality of figures has two axes of symmetry which are perpendicular to each other.

9. A method according to claim 1, wherein a ratio of a first length of each of the plurality of figures along the at least one axis of symmetry and a second length of each of the plurality of figures along a perpendicular axis perpendicular to the at least one axis of symmetry is substantially from 0.8 to 1.2.

10. A method according to claim 9, wherein the ratio of the first length and the second length is substantially from 0.9 to 1.1.

11. A method according to claim 1, wherein the plurality of figures are circles.

12. A method according to claim 11, wherein the at least one dimension of the extrusion die are determined based on diameters of the circles.

13. A method according to claim 1, wherein the plurality of figures are ellipses.

14. A method according to claim 13, wherein the at least one dimension of the extrusion die are determined based on long diameters of the ellipses, short diameters of the ellipses, or averages of long and short diameters of the ellipses.

15. A method according to claim 1, wherein the plurality of figures are polygons.

16. A method according to claim 15, wherein the at least one dimension of the extrusion die are determined based on lengths of lines connecting a center of the polygons and vertexes of the polygons.

17. A method according to claim 15, wherein the plurality of figures are regular polygons.

18. A method according to claim 15, wherein the plurality of figures are equilateral or inequilateral polygons.

19. A method according to claim 1, wherein the plurality of figures are star shapes.

20. A method according to claim 19, wherein the at least one dimension of the extrusion die are determined based on diameters of circles in which the star shapes are inscribed.

21. A method according to claim 1, wherein the plurality of figures are loop-shaped figures each of which is formed by combining two U-shaped figures.

22. A method according to claim 21, wherein the at least one dimension of the extrusion die are determined based on long diameters of the loop-shaped figures, short diameters of the loop-shaped figures, or averages of long and short diameters of the loop-shaped figures.

23. A method according to claim 1, wherein the sizes of the plurality of figures are defined as values which represent thicknesses, at respective reference points, of products to be produced by using the extrusion die.

24. A method according to claim 1, wherein the at least one dimension of the extrusion die is a flow guide dimension of a flow guide of the extrusion die.

25. A method according to claim 24, wherein the plurality of figures are circles, and wherein the flow guide dimension and a shape of the flow guide is determined such that a plurality of enlarged circles which are provided coaxially with the circles by enlarging the circles respectively are inscribed in the shape of the flow guide.

26. A method according to claim 25, wherein an enlarged diameter of each of the plurality of enlarged circles is calculated by multiplying a diameter of each of the circles and a coefficient together.

27. A method according to claim 25, wherein an enlarged diameter (D) of each of the plurality of enlarged circles is calculated according to the following function, $$D=f(X_1, X_2, X_3, L, \alpha_1, \ldots \alpha_n),$$

where $X_1$: a diameter of each of the circles, $X_2$: a diameter of a maximum circle among the circles, $X_3$: a diameter of a maximum enlarged circle among the enlarged circles, L: a sleeve distance between a center of a container of a extruder and each of the circles, and $\alpha$(i=1 to n): a correction coefficient.

28. A method according to claim 1, wherein the at least one dimension of the extrusion die is a bearing wall length of the extrusion die.

29. A method according to claim 28, wherein the plurality of figures are circles, and wherein the bearing wall length ($L_b$) of the extrusion die is calculated according to the following function, $$L_b=f(X_1, X_2, X_3, L, A, \beta_1, \ldots \beta_n),$$

where $X_1$: a diameter of each of the circles, $X_2$: a diameter of an enlarged circle which is provided by enlarging each of the circles, $X_3$: a diameter of a maximum circle among the circles, L: a sleeve distance between a center of a container of a extruder and each of the circles, A: an alloy coefficient, and $\beta$(i=1 to n): a correction coefficient.

30. A method according to claim 28, wherein the plurality of figures are circles, and wherein the bearing wall length is determined to increase when the diameters of the circles to increase, a sleeve distance between a center of a container of an extruder and each of the circles decreases, or the material to be extruded becomes softer.

31. A method according to claim 28, wherein the plurality of figures are circles, and wherein the bearing wall length ($L_b$) of the extrusion die is calculated according to the following function, $$L_b=f(X_1, X_2, X_3, L, A, M, \beta_1, \ldots \beta_n),$$

where $X_1$: a diameter of each of the circles, $X_2$: a diameter of a chamber circle which is provided by enlarging each of the circles, $X_3$: a diameter of a maximum circle among the circles, L: a bridge distance between a center of each of the circles and an end point of a bridge along a line connecting the center and a gravity center of a port, A: an alloy coefficient, M: a contact coefficient which represents whether each of the circles contacts a mandrel, and $\beta$(i=1 to n): a correction coefficient.

32. A method according to claim 28, wherein the plurality of figures are circles, and wherein the bearing wall length is determined to increase when the diameters of the circles increase, a bridge distance bridge distance between a center of each of the circles and an end point of a bridge along a line connecting the center and a gravity center of a port decreases, the material to be extruded becomes softer, or each of the circles does not contact a mandrel.

33. A method according to claim 1, wherein the at least one dimension of the extrusion die is a chamber dimension of a chamber of the extrusion die.

34. A method according to claim 33, wherein the plurality of figures are circles, and wherein the chamber dimension and a shape of the chamber is determined such that a plurality of enlarged circles which are provided by enlarging the circles respectively are inscribed in the shape of the chamber.

35. A method according to claim 34, wherein an enlarged diameter (D) of each of the plurality of enlarged circles is calculated according to the following function, $$D=f(X_1, X_2, X_3, L, \alpha_1, \ldots \alpha_n),$$

where $X_1$: a diameter of each of the circles, $X_2$: a diameter of a maximum circle among the circles, $X_3$: a diameter of a maximum enlarged circle among the enlarged circles, L: a bridge distance between a center of each of the circles and an end point of a bridge along a line connecting the center and a gravity center of a port, and $\alpha$(i=1 to n): a correction coefficient.

36. A method of claim 1, wherein the steps of claim 1 are performed by a computer.

37. A method of producing an extrusion die including an opening through which material is extruded, comprising:

determining a plurality of reference points on a contour of the opening of the extrusion die;

determining sizes of a plurality of figures with same shapes corresponding to the plurality of reference points, each of the plurality of figures being inscribed in the contour of the opening and having at least one axis of symmetry, each of the plurality of figures contacting each of the plurality of reference points and at least one another point on the contour;

determining the at least one dimension of the extrusion die based on the sizes of the plurality of figures; and producing the extrusion die based on the at least one dimension.

38. An extrusion die comprising:

an opening through which material is extruded; and at least one portion having a dimension determined based on sizes of a plurality of figures with same shapes, each of the plurality of figures having at least one axis of symmetry and being determined corresponding to each of a plurality of reference points which are determined on a contour of the opening, each of the plurality of figures being inscribed in the contour of the opening and contacting each of the plurality of reference points and at least one another point on the contour.

39. An extrusion die according to claim 38, wherein the plurality of reference points are determined such that intervals between adjoining two points of the plurality of reference points are substantially equal.

40. An extrusion die according to claim 38, wherein the plurality of reference points are determined such that intervals between adjoining two points of the plurality of reference points vary.

41. An extrusion die according to claim 38, wherein each of the plurality of figures has two axes of symmetry which are perpendicular to each other.

42. An extrusion die according to claim 38, wherein a ratio of a first length of each of the plurality of figures along the at least one axis of symmetry and a second length of each of the plurality of figures along a perpendicular axis perpendicular to the at least one axis of symmetry is substantially from 0.8 to 1.2.

43. An extrusion die according to claim 42, wherein the ratio of the first length and the second length is substantially from 0.9 to 1.1.

44. An extrusion die according to claim 38, wherein the plurality of figures are circles.

45. An extrusion die according to claim 44, wherein the at least one dimension of the extrusion die are determined based on diameters of the circles.

46. An extrusion die according to claim 38, wherein the at least one portion of the extrusion die is a flow guide.

47. An extrusion die according to claim 46, wherein the plurality of figures are circles, and wherein the dimension and a shape of the flow guide is determined such that a plurality of enlarged circles which are provided coaxially with the circles by enlarging the circles respectively are inscribed in the shape of the flow guide.

48. An extrusion die according to claim 38, wherein the at least one portion of the extrusion die is a bearing wall having a bearing wall length.

49. An extrusion die according to claim 38, wherein the at least one portion of the extrusion die is a chamber.

50. An extrusion die according to claim 49, wherein the plurality of figures are circles, and wherein the dimension and a shape of the chamber is determined such that a plurality of enlarged circles which are provided by enlarging the circles respectively are inscribed in the shape of the chamber.

51. A flow guide for an extrusion die including an opening through which material is extruded, comprising:

a portion having a dimension determined based on sizes of a plurality of figures with same shapes, each of the plurality of figures having at least one axis of symmetry and being determined corresponding to each of a plurality of reference points which are determined on a contour of the opening, each of the plurality of figures being inscribed in the contour of the opening and contacting each of the plurality of reference points and at least one another point on the contour.

52. A chamber for an extrusion die including an opening through which material is extruded, comprising:

a portion having a dimension determined based on sizes of a plurality of figures with same shapes, each of the plurality of figures having at least one axis of symmetry and being determined corresponding to each of a plurality of reference points which are determined on a contour of the opening, each of the plurality of figures being inscribed in the contour of the opening and contacting each of the plurality of reference points and at least one another point on the contour.

53. An extrusion die designing apparatus to design an extrusion die including an opening through which material is extruded, comprising:

a reference point determining device configured to determine a plurality of reference points on a contour of the opening of the extrusion die;

a figure size determining device configured to determine sizes of a plurality of figures with same shapes corresponding to the plurality of reference points, each of the plurality of figures being inscribed in the contour of the opening and having at least one axis of symmetry, each of the plurality of figures contacting each of the plurality of reference points and at least one another point on the contour; and a dimension determining device configured to determine at least one dimension of the extrusion die based on the sizes of the plurality of figures.

54. An extrusion die designing apparatus according to claim 53, wherein the plurality of reference points are determined such that intervals between adjoining two points of the plurality of reference points are substantially equal.

55. An extrusion die designing apparatus according to claim 53, wherein the plurality of reference points are determined such that intervals between adjoining two points of the plurality of reference points vary.

56. An extrusion die designing apparatus according to claim 53, wherein each of the plurality of figures has two axes of symmetry which are perpendicular to each other.

57. An extrusion die designing apparatus according to claim 53, wherein a ratio of a first length of each of the plurality of figures along the at least one axis of symmetry and a second length of each of the plurality of figures along a perpendicular axis perpendicular to the at least one axis of symmetry is substantially from 0.8 to 1.2.

58. An extrusion die designing apparatus according to claim 57, wherein the ratio of the first length and the second length is substantially from 0.9 to 1.1.

59. An extrusion die designing apparatus according to claim 53, wherein the plurality of figures are circles.

60. An extrusion die designing apparatus according to claim 59, wherein the at least one dimension of the extrusion die are determined based on diameters of the circles.

61. An extrusion die designing apparatus according to claim 53, wherein the at least one portion of the extrusion die is a flow guide.

62. An extrusion die designing apparatus according to claim 61, wherein the plurality of figures are circles, and wherein the dimension and a shape of the flow guide is determined such that a plurality of enlarged circles which are provided coaxially with the circles by enlarging the circles respectively are inscribed in the shape of the flow guide.

63. An extrusion die designing apparatus according to claim 53, wherein the at least one portion of the extrusion die is a bearing wall having a bearing wall length.

64. An extrusion die designing apparatus according to claim 53, wherein the at least one portion of the extrusion die is a chamber.

65. An extrusion die designing apparatus according to claim 64, wherein the plurality of figures are circles, and wherein the dimension and a shape of the chamber is determined such that a plurality of enlarged circles which are provided by enlarging the circles respectively are inscribed in the shape of the chamber.

66. An extrusion die designing apparatus to design an extrusion die including an opening through which material is extruded, comprising:

reference point determining means for determining a plurality of reference points on a contour of the opening of the extrusion die;

figure size determining means for determining sizes of a plurality of figures with same shapes corresponding to the plurality of reference points, each of the plurality of figures being inscribed in the contour of the opening and having at least one axis of symmetry, each of the plurality of figures contacting each of the plurality of reference points and at least one another point on the contour; and dimension determining means for determining at least one dimension of the extrusion die based on the sizes of the plurality of figures.

67. An extrusion die producing system to produce an extrusion die including an opening through which material is extruded, comprising:

a reference point determining device configured to determine a plurality of reference points on a contour of the opening of the extrusion die;

a figure size determining device configured to determine sizes of a plurality of figures with same shapes corresponding to the plurality of reference points, each of the plurality of figures being inscribed in the contour of the opening and having at least one axis of symmetry, each of the plurality of figures contacting each of the plurality of reference points and at least one another point on the contour;

a dimension determining device configured to determine at least one dimension of the extrusion die based on the sizes of the plurality of figures; and a machine configured to produce the extrusion die based on the at least one dimension.

68. A computer readable media for controlling a computer to perform the steps of:

determining a plurality of reference points on a contour of the opening of the extrusion die;

determining sizes of a plurality of figures with same shapes corresponding to the plurality of reference points, each of the plurality of figures being inscribed in the contour of the opening and having at least one axis of symmetry, each of the plurality of figures contacting each of the plurality of reference points and at least one another point on the contour; and determining the at least one dimension of the extrusion die based on the sizes of the plurality of figures.

* * * * *